US005247314A

United States Patent [19]

Stephenson

[11] Patent Number: 5,247,314

[45] Date of Patent: Sep. 21, 1993

[54] MULTIWEB PRINTER SYSTEM WITH END OF WEB RESPONSIVE CONTROL

[75] Inventor: Stanley W. Stephenson, Spencerport, N.Y.

[73] Assignee: Eastman Kodak Company, Rochester, N.Y.

[21] Appl. No.: 833,476

[22] Filed: Feb. 10, 1992

[51] Int. Cl.[5] ..... B41J 2/325; B41M 5/34

[52] U.S. Cl. ..... 346/76 PH; 400/249; 400/120

[58] Field of Search ..... 346/76 PH; 400/120 MC, 400/120 MP, 249

[56] References Cited

U.S. PATENT DOCUMENTS

| | | | |
|---|---|---|---|
| Re. 33,260 | 7/1990 | Stephenson | 346/76 PH |
| 4,507,667 | 3/1985 | Tsuboi | 346/76 PH |
| 4,620,199 | 10/1986 | Tatsumi et al. | 400/240.3 |
| 4,863,297 | 9/1989 | Fujii | 400/249 |
| 5,037,218 | 8/1991 | Shimizu et al. | 400/240.3 |

FOREIGN PATENT DOCUMENTS

| | | | |
|---|---|---|---|
| 0178081 | 9/1985 | Japan | 400/240.3 |
| 0230887 | 11/1985 | Japan | 400/240.3 |
| 0074677 | 4/1988 | Japan | 400/120 MP |
| 0209980 | 8/1988 | Japan | 400/120 MP |
| 0231977 | 9/1988 | Japan | 400/249 |

*Primary Examiner*—Benjamin R. Fuller
*Assistant Examiner*—N. Le
*Attorney, Agent, or Firm*—Milton S. Sales

[57] ABSTRACT

A multicolor printing device has a plurality of successive print heads along a path to print images from a dye web of a respectively different color at each head on a dye receiving sheet successively advanced to each head in a set of printing cycles corresponding to the number of heads. The device is operated under end of web roll responsive control to prevent any web from reaching an end of roll condition during a set of printing cycles. Each web has a predetermined number of successive dye areas and intervening dye-free areas that are sensed and counted, as the web moves in increments in the successive cycles, to control the operation and to register the successive dye areas with the associated head. When the count indicates that the number of dye areas not yet subjected to a printing cycle on the web at any head corresponds to the number of heads preceding that head along the path, the device is controlled to prevent further cycle operation at the first head while permitting respective completion of the cycle operations for already advanced sheets at the remaining heads.

17 Claims, 6 Drawing Sheets

MULTIWEB PRINTER SYSTEM WITH END OF WEB RESPONSIVE CONTROL

FIELD OF THE INVENTION

This invention relates to a multiweb printer system with end of web responsive control, such as a multihead multicolor thermal printer with such control, and its so controlled operating method.

BACKGROUND OF THE INVENTION

In certain thermal printers, a thermal head is modulated (energized) to transfer dye from a dye bearing web (donor, carrier), such as an ink film, to a dye receiving sheet (medium), such as recording paper, to print images in a predetermined, e.g., margin defined, print area thereon, by known heat transfer technique. Typically, the web is interposed between the head and the sheet, and the head is urged against the web and sheet during printing for efficient dye transfer from the web to the sheet.

In each printing cycle, the sheet is advanced to register its print area with the head, whereupon the head is moved from an inactive position to an active position, e.g., from a position spaced from the sheet to a position in urging contact with the web and sheet, and is then energized to effect printing. The web and sheet move in unison at uniform speed past the head during printing. At the end of the cycle, the head is moved to spaced position and the process is repeated for the next cycle.

For line printing, where the head spans the transverse width of the web and sheet print area, in crosswise relation thereto, the web and sheet move longitudinally an increment equal to the printing line height to register them with the head for printing the next line. When printing a continuous longitudinal portion of the sheet, as in forming a graphic design of contiguous printed lines, compared to spaced text lines, the web and sheet move continuously at uniform speed past the head for such line printing.

Typically, the web is wound as a roll on a payout spool for payout, travel past the head, and takeup on a takeup spool. The takeup spool is usually driven by a motor to conduct the web past the head at uniform speed during printing. The sheet is typically fed at the start of a cycle to register its print area with the head, and then travels past the head in unison with the web during printing. This travel in unison is coordinated with the modulation of the head by known technique to effect the printing.

In certain single color thermal printers, the head is modulated to transfer dye from a single color dye bearing web to the sheet to print images on its print area.

In certain multicolor printers, the web has a repeating series of successive dye bearing areas of different colors, e.g., yellow, magenta and cyan, and the sheet is conducted repeatedly past the head to transfer dye from each color area of the series in turn to the same print area. In others, a plurality of heads is arranged in succession, each with a dye bearing web of a single color different from the others, and the sheet is conducted past each head in turn to transfer dye of each color to the same print area.

In some of these printers, a rotating platen drum conducts the sheet past the given head. Typically, in a multicolor printer with a single head having a web of a repeating series of different color dye areas, a single drum reregisters the sheet with the head to print the next color thereon. Typically, in a multicolor printer with a plurality of heads, each having a different color web, either a different drum is used for each head, or the heads are arranged around one drum that conducts the sheet past each head.

Each platen drum is typically driven by a motor coordinated with the associated web takeup spool motor so that the modulation of the head and rotation of both the drum and takeup spool produce a series of pixel elements of correct aspect ratio on the sheet.

For instance, to attain a 1:1 length to height pixel aspect ratio, corresponding to the printing of a line of undistorted square images, e.g., each of a 0.003 inch pixel length and a 0.003 inch pixel height, the head must be modulated (energized) for a modulation time concordant with the rotational (peripheral) speed of both the drum and the web being taken up by the takeup spool. This concordance must be such that the sheet and web are conducted at a proper uniform linear speed for an incremental length of the sheet and of the web, equal to the pixel image height, to travel in unison past the head in a travel time equal to the modulation time.

If the drum is not driven but rather is an idler drum, motor driven conveying rollers move the sheet through a nip between the head and drum. Here, the conveying roller motor is coordinated with the given web takeup spool motor so that the head modulation and rotation of the conveying rollers and takeup spool produce a series of pixel elements of correct aspect ratio on the sheet.

Printing is staggered in those multicolor printers with a plurality of heads arranged in succession, each having a different color web from the others. This is because a sheet moves past each head in turn to transfer dye of each color to the same print area. Thus, in a cycle of a three color printer that prints successively yellow, magenta and cyan in superimposed images on each sheet, the first head prints images from a yellow web on a fresh sheet, while the second head prints images from a magenta web on a sheet already printed with yellow images, and the third head prints images from a cyan web on a sheet already printed with yellow and magenta images.

In the first cycle of a three color (three cycle) run, a first sheet is advanced to and printed at the first head, while the second and third heads are idle. In the second cycle, the first sheet is advanced to and printed at the second head and a second sheet is advanced to and printed at the first head, while the third head is idle. In the third cycle, the first sheet is advanced to and printed at the third head, the second sheet is advanced to and printed at the second head, and a third sheet is advanced to and printed at the first head. The set of three cycles is repeated for each sheet, which leave the third head as completed print products.

At the end of the run, i.e., in the next to last cycle of the last three cycle set, the advancing of a sheet to and printing at the first head are prevented, so that the first head is idle while the already advanced sheets at the second and third heads are printed. In the last cycle, the advancing of a sheet to and printing at the first and second heads are prevented, so that the first and second heads are idle while the sheet previously at the second head is advanced to and printed at the third head.

A problem with this staggered cycle printing of different colors on the same sheet at successive heads is that a web may reach its end of roll or "empty" condition at any random time during a printing cycle. The run must then be aborted and the empty web replaced by a fresh web, before the run, i.e., in sets of three cycles, can be resumed. As a result, the partially printed sheets at the three heads are normally discarded, and a new first cycle is started with a fresh sheet at the first head and none at the second and third heads. This leads to wastage of the discarded sheets and of the web portions used for their partial printing.

It is desirable to prevent this wastage by controlling the printing so as to avoid an end of roll condition of any web during a cycle of such a successive head multiple cycle arrangement.

One way is to provide marks or codes at the terminal ends of the webs for detection to indicate the approach of an end of roll condition of each web. The code of a web at a given head must be spaced from its terminal end a distance sufficient to complete the printing of the sheet at that head and at each preceding head. This entails placing the code at a first distance from the terminal end of the web at the first head, at a longer distance from the terminal end of the web at the second head, and at a still longer distance from the terminal end of the web at the third head.

The first distance must be at least the length of the sheet print area for full printing at the first head of the sheet then at the first head. The second distance must at least twice the first distance for full printing successively at the second head of the sheet then at the second head and the sheet then at the first head. The third distance must be at least three times the first distance for full printing successively at the third head of the sheet then at the third head and those then at the first and second heads.

Also, this limits use of the first distance coded web only at the first head, the second distance coded web only at the second head, and the third distance coded web only at the third head. More important, the only practical way of providing such codes on the webs is to add them to the webs by separate manufacturing steps after web fabrication. This undesirably burdens production costs.

Various thermal printer arrangements are known for single color or multicolor printing of sheets (image receiving members), using dye bearing webs (film or ribbon continous materials). Examples of such arrangements are shown in the following prior art.

U.S. Pat. No. 4,507,667 (Tsuboi) discloses a single head thermal printer with a black ink film as a continuous, single color dye layer web for printing images on paper. During printing, the paper moves past the head via a rotating platen roller, and the film moves past the head as it is fed from a payout roll and increasingly wound on a takeup roll. Complex and costly means decrease progressively the rotational speed of the takeup roll relative to that of the platen roller to compensate for the increasing film radius on the takeup roll, while keeping constant the travel speed of the film and paper. The head forces the film against the paper during printing, creating wrinkles that cause local transfer failure. Complex and costly means remove the wrinkles by a randomly repeated procedure of temporarily releasing the head force, and pulling the film an increment past the head. As the film is used in random increments by this procedure, its rate of use is non-uniform and its end of roll condition cannot be accurately monitored. Thus, the film may reach its end of roll condition during printing, requiring film roll reloading and resulting in wastage of the incompletely printed paper portion.

Commonly assigned U.S. Pat. No. Re. 33,260 (Stephenson, i.e., the inventor herein) discloses a single head thermal printer that sequentially prints different colors from a multicolor web on the same sheet in successive cycles. The web is a light-transmitting carrier having a continuous dye layer of a repeating series of different color dye bearing areas (frames), e.g., yellow, magenta and cyan. On printing one color when a frame and the sheet are registered with the head, the sheet is reregistered with the head and the next frame is registered therewith to print its color. Light emitters and detectors cooperate to identify the colors as the frames move in the printing cycles. The intensity of a given type emitted light is detected by a given detector on passing through the web at a given color frame. The detectors generate signals used by a logic circuit to control cycle operation. This single head printer does not involve staggered printing on the same sheet at successive heads as occurs with a multihead printer.

U.S. Pat. No. 4,863,297 (Fujii) discloses a multihead thermal printer with a plurality of, e.g., three, heads arranged in succession around a platen roller (drum) for sequentially printing different colors, e.g., yellow, magenta and cyan, on the same sheet. The sheet is fed to the platen roller for rotation to each head in turn. Each head has an ink film as a dye bearing web with a continuous dye layer of a color different from the others. Each film has a detectable end of roll mark (code) at a distance from its terminal end different from those of the others concordant with the successive position of the associated head relative to the platen roller. Each mark must be sufficiently ahead of the film end so that on detection the printing at all heads of a sheet then at the first head can be completed while feeding of the next sheet to the first head is prevented. Providing such a mark on each film is complicated and expensive, as it differs in position on the film concordant with that of the associated head around the platen roller, and must be added in a separate manufacturing step after completion of the fabrication of each film. Besides, this coding limits use of each web only at the head for which it is coded.

It is desirable to avoid such additional manufacturing steps for including means to indicate the end of roll condition of a web of a multiweb printer with successively arranged heads, yet provide end of roll responsive control.

SUMMARY OF THE INVENTION

The foregoing drawbacks have been obviated by providing each of a plurality of printing means (heads) of a printing device with a transfer web (donor) having a known number of successive dye bearing areas (frames, patches). The dye areas are counted as they are used to print images on successive dye receiving sheets. The count indicates the approach of the end of web (end of roll) or "empty" condition of each web to control means that prevent such condition from occurring during a set of printing cycles used to print images on a given sheet at each successive station.

The multiweb printer system with end of web responsive control in accordance with the invention contemplates a printer, such as a multiweb multicolor thermal printing device, with end of roll responsive control, and a method of operating the printer under such responsive control.

In these printers, each printing station transfers dye of a specific color from a web at the associated printing head to the same dye receiving sheet upon its travel in turn to each station. Thus, where there are four stations, a set of four successive cycles is used to print images of four different colors on the same sheet in staggered manner at the successive stations. Each web is typically mounted between a payout spool and a takeup spool at the associated head. It is advantageous to know beforehand when the last dye area is about to be printed by the head at any station.

The system device and method of the invention are used to determine this end of roll condition, for preventing the printing of a fresh sheet at the first station with less than the needed dye areas on each web to complete its printing at all stations. Areas without dye are disposed on each web to identify the start of successive dye areas. Sensing and counting means sense and count these areas to control the successive cycle printing so that an end of roll condition is avoided during a set of cycles used to print images on a sheet at each of the stations. This technique inexpensively achieves end of roll responsive control with uniform advance of the web at each station from one dye area to the next for successive cycle printing in a manner unaffected by variations in the wound web diameters on the payout and takeup spools.

In accordance with the present invention, a printing device is provided, which comprises a plurality of, e.g., thermal, printing means (heads), associated longitudinal dye transfer webs, advancing means, moving means, sensing and counting means, and control means.

The plurality of printing means is arranged in succession along a path for individual operation in successive printing cycles. The advancing means individually advance dye receiving sheets in succession along the path to each printing means for respective printing in a respective cycle at each printing means. Each printing means has an associated longitudinal dye transfer web specially formed in accordance with the invention.

Each specially formed longitudinal dye transfer web has a predetermined number of longitudinally successive, e.g., thermal, transfer dye bearing areas of constant first length disposed therealong, and longitudinally intervening dye-free areas of constant second length disposed therealong to delimit longitudinally the successive dye bearing areas. A dye bearing area and an adjacent dye-free area together define a metering increment of constant third length equal to the sum of the first and second lengths. The dye bearing areas are all of the same color, which is independent of the color of the dye bearing areas of the web of each other printing means.

The moving means individually move the web of each printing means a respective metering increment along the path to that printing means for dye transfer from a respective dye bearing area to a respective sheet for printing thereof in a respective cycle.

The sensing and counting means individually sense the successive dye bearing areas and dye-free areas of the web of each printing means upon moving said areas to that printing means in the cycles, and count the sensed dye bearing areas. The counted areas indicate, relative to the predetermined number of dye bearing areas of the web of a given printing means, the number of dye bearing areas already subjected to a cycle and the number of remaining (unused) dye bearing areas not yet subjected to a cycle.

The control means controls the cycle operation of the advancing means, printing means and moving means. The control means is responsive to the sensing and counting means. When the number of remaining dye bearing areas of the web of any printing means at the end of a cycle corresponds to the number of printing means preceding that printing means along the path, the control means prevents further cycle operation at the first successive printing means. At the same time, the control means permits respective completion of the cycle operations for already advanced sheets at the remaining successive printing means.

The control means desirably prevents the advancing of a sheet to the first printing means when the number of remaining dye bearing areas of the web of any printing means at the end of a cycle corresponds to the number of printing means preceding that printing means along the path.

According to one feature, each web has substantially non-contiguous, discrete dye bearing areas longitudinally successively spaced by the intervening dye-free areas. The web has longitudinal side edges defining a selective transverse width therebetween.

According to an alternative feature, each dye-free area extends transversely across a portion of the web width and the remaining web width portion is provided with a bridging dye bearing portion substantially contiguous with the dye bearing areas adjacent the dye-free area. The bridging dye bearing portions and dye bearing areas form a substantially continuous dye layer longitudinally along the web. This is longitudinally interrupted by intervening dye-free areas defining successive substantially isolated dye-free apertures in the continuous dye layer.

The color of the dye bearing areas of each web is different from that of the dye bearing areas of each other web. Thus, the dye bearing areas of one web may be black or one subtractive primary color and the dye bearing areas of each other web may be respectively a different subtractive primary color. If the device has three printing means and associated webs, the webs respectively may have yellow, magenta and cyan dye bearing areas. If the device has four printing means and associated webs, the webs respectively may have yellow, magenta, cyan and black dye bearing areas.

Each web may be a substantially optically clear substrate film with an active dye transfer surface on which the dye bearing areas and dye-free areas are disposed, and an opposed inactive surface.

The sensing and counting means may comprise, for each web, a light emitter, a light detector and a counter. The emitter emits a light beam capable of producing a first type light when directed onto a dye bearing area, and of producing a second type light different from the first type light when directed onto a dye-free area. The detector individually detects the first type light and the second type light. The counter is responsive to the detector to provide a count corresponding to the successive instances of detected first type light.

The inactive surface of each web may have a reflective coating, such as a black dye, to reflect light directed onto the inactive surface through the active surface of the web. The sensing and counting means may comprise, for each web, a light emitter, a light detector and a counter that operate on the basis of reflected light. The emitter emits a light beam capable of producing a first type reflected light when directed onto the coating through a dye bearing area on the active surface, and of producing a second type reflected light different from the first type reflected light when directed onto the coating through a dye-free area. The detector individually detects the first type reflected light and the second type reflected light. The counter is responsive to the detector to provide a count corresponding to the successive instances of detected first type reflected light.

In particular, each printing means comprises a, e.g., thermal, printing head. The moving means are controlled by the control means to move each web a metering increment to register its next, e.g., thermal, transfer dye bearing area with its corresponding head for the next cycle. Each web is wound as a roll on a payout spool for payout adjacent the corresponding head. Each web has a terminal end provided with a fixation point spaced a predetermined longitudinal distance from the last dye bearing area. Each web is affixed to its payout spool at the fixation point. The predetermined distance of each web may correspond substantially to the distance between its fixation point and the corresponding head after the last dye bearing area has been subjected to a cycle.

The present invention independently contemplates the above described specially formed longitudinal dye transfer web, e.g., of thermal transfer dye bearing areas, for use in successive printing cycles at a printing means (head) of a thermal printing device. The web has a terminal end provided with a fixation point spaced a predetermined longitudinal distance from the last dye bearing area for affixing the web to a payout spool at the fixation point. The predetermined distance may correspond substantially to the distance between the fixation point and the printing means (head) of the printing device after the last dye bearing area has been subjected to a printing cycle at the printing means.

The present invention also contemplates a payout spool having wound as a roll thereon a said longitudinal dye transfer web for payout therefrom for use in successive printing cycles at a printing means of a printing device. The web has a terminal end provided with a fixation point spaced a said predetermined distance from the last dye bearing area, with the web being affixed to the spool at the fixation point.

The present invention further contemplates a method of operating a, e.g., thermal, printing device, i.e., comprising a plurality of, e.g., thermal, printing means arranged in succession along a path for individual operation in successive cycles.

The method comprises providing each printing means with an associated said specially formed longitudinal dye transfer web, e.g., of thermal transfer dye bearing areas, individually advancing sheets in succession along the path to each printing means for respective printing in a respective cycle at each printing means, and individually moving the web of each printing means a respective metering increment along the path to that printing means for dye transfer from a respective said dye bearing area to a respective sheet for printing thereof in a respective cycle.

The method additionally comprises individually sensing the successive dye bearing areas and dye-free areas of the web of each printing means upon moving said areas to that printing means in the cycles, and counting the sensed dye bearing areas and thereby indicating, relative to the predetermined number of dye bearing areas of the web of a given printing means, the number of dye bearing areas already subjected to a cycle and the number of remaining dye bearing areas not yet subjected to a cycle.

The method further comprises controlling the cycle operation so that when the number of remaining dye bearing areas of the web of any printing means at the end of a cycle corresponds to the number of printing means preceding that printing means along the path, further cycle operation is prevented at the first successive printing means while respective completion of the cycle operations is permitted for already advanced sheets at the remaining successive printing means. In particular, the preventing of further cycle operation at the first printing means includes preventing the advancing of a sheet to the first printing means.

The invention will be more readily understood from the following detailed description taken with the accompanying drawings and claims.

It is noted that the drawings are not to scale, some portions being shown exaggerated to make the drawings easier to understand.

DETAILED DESCRIPTION

Figure 1:
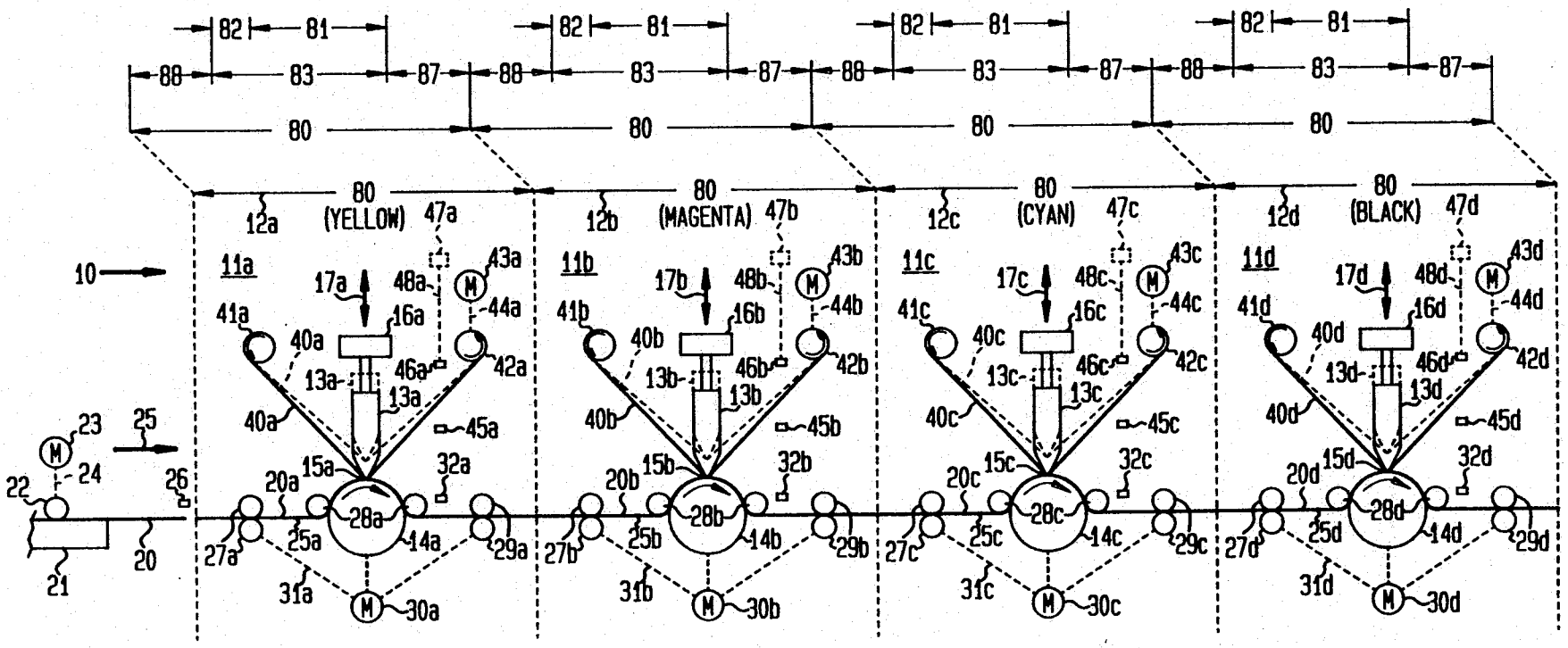
FIG. 1 is a schematic view of a thermal printing device, with four thermal heads and associated dye bearing webs arranged along a longitudinal path to effect four color printing of individual dye receiving sheets in accordance with an embodiment of the invention.

Referring now to FIG. 1, there is shown a thermal printing device 10 in accordance with one embodiment of the invention. Device 10 has modules 11*a*, 11*b*, 11*c* and 11*d*, stations 12*a*, 12*b*, 12*c* and 12*d*, printing heads 13*a*, 13*b*, 13*c* and 13*d*, platen drums 14*a*, 14*b*, 14*c* and 14*d*, printing nips 15*a*, 15*b*, 15*c* and 15*d*, solenoids 16*a*, 16*b*, 16*c* and 16*d*, transverse paths 17*a*, 17*b*, 17*c* and 17*d*, sheets 20, 20*a*, 20*b*, 20*c* and 20*d*, a tray 21, a feed roller 22, a feed motor 23, a motor linkage 24, a longitudinal path 25, path portions 25*a*, 25*b*, 25*c* and 25*d*, a reload sensor 26, upstream rollers 27*a*, 27*b*, 27*c* and 27*d*, pinch rollers 28*a*, 28*b*, 28*c* and 28*d*, downstream rollers 29*a*, 29*b*, 29*c* and 29*d*, conveying motors 30*a*, 30*b*, 30*c* and 30*d*, motor linkages 31*a*, 31*b*, 31*c* and 31*d*, edge sensors 32*a*, 32*b*, 32*c* and 32*d*, payout spools 41*a*, 41*b*, 41*c* and 41*d*, takeup spools 42*a*, 42*b*, 42*c* and 42*d*, takeup motors 43*a*, 43*b*, 43*c* and 43*d*, and motor linkages 44*a*, 44*b*, 44*c* and 44*d*.

Device 10 is provided with specially formed dye bearing webs 40*a*, 40*b*, 40*c* and 40*d*, plus emitters 45*a*, 45*b*, 45*c* and 45*d*, detectors 46*a*, 46*b*, 46*c* and 46*d*, counters 47*a*, 47*b*, 47*c* and 47*d*, and signal lines 48*a*, 48*b*, 48*c* and 48*d*, in accordance with the invention. Device 10 is concordantly demarked by repeating station lengths 80, formed of dye bearing area first lengths 81, dye-free area second lengths 82, metering increment third lengths 83, upstream lengths 87 and downstream lengths 88.

Device 10 comprises a conventional multicolor printer of, e.g., four, generally identical successive printing modules 11*a*, 11*b*, 11*c* and 11*d* correspondingly located at stations 12*a*, 12*b*, 12*c* and 12*d*, and having thermal printing heads 13*a*, 13*b*, 13*c* and 13*d*, and associated rotatable platen drums 14*a*, 14*b*, 14*c* and 14*d*, arranged to form corresponding printing nips 15*a*, 15*b*, 15*c* and 15*d*. Each of heads 13*a*, 13*b*, 13*c* and 13*d* has a plurality of elements (not shown) energizable to generate images on a responsive imaging material, and thus to print images of four colors, e.g., yellow, magenta, cyan and black, respectively, in superimposed relation on the same print area of each successive image receiving sheet 20, e.g., of recording paper, in a given printing run.

Heads 13*a*, 13*b*, 13*c* and 13*d* are connected to solenoids 16*a*, 16*b*, 16*c* and 16*d* for movement along transverse paths indicated by arrows 17*a*, 17*b*, 17*c* and 17*d*, between an inactive spaced position (shown in dashed line in FIG. 1) and an active contact position relative to drums 14*a*, 14*b*, 14*c* and 14*d*. In the contact position, heads 13*a*, 13*b*, 13*c* and 13*d* form nips 15*a*, 15*b*, 15*c* and 15*d* with drums 14*a*, 14*b*, 14*c* and 14*d*, typically under slight compression.

In a given run, sheets 20 are individually fed from a supply thereof in a tray 21 by a feed roller 22 driven by a feed motor 23 via a drive linkage 24 (shown schematically in FIG. 1). Sheets 20 travel along a longitudinal path indicated by the arrow 25 for advance in turn along the successive path portions indicated by the corresponding arrows 25*a*, 25*b*, 25*c* and 25*d* at stations 12*a*, 12*b*, 12*c* and 12*d*. A reload sensor 26 may be located at tray 21 to indicate the "empty" sheet condition of tray 21.

Pairs of coacting upstream conveying rollers 27*a*, 27*b*, 27*c* and 27*d* are located at the upstream sides of drums 14*a*, 14*b*, 14*c* and 14*d* to convey successive sheets 20*a*, 20*b*, 20*c* and 20*d* to the drums. Pairs of pinch rollers 28*a*, 28*b*, 28*c* and 28*d* are located on the opposed sides of drums 14*a*, 14*b*, 14*c* and 14*d* to maintain the sheets in proper stationary contact with the drums for travel past nips 15*a*, 15*b*, 15*c* and 15*d*. Pairs of coacting downstream conveying rollers 29*a*, 29*b*, 29*c* and 29*d* are located at the downstream sides of drums 14*a*, 14*b*, 14*c* and 14*d* to convey the sheets therefrom.

Drums 14*a*, 14*b*, 14*c* and 14*d*, and their associated upstream rollers 27*a*, 27*b*, 27*c* and 27*d*, and downstream rollers 29*a*, 29*b*, 29*c* and 29*d*, are driven (indexed) in concordant controlled manner by conveying motors 30*a*, 30*b*, 30*c* and 30*d* via drive linkages 31*a*, 31*b*, 31*c* and 31*d* (shown schematically in FIG. 1). Thus, sheets 20 are conveyed along path 25 so that successive sheets 20*a*, 20*b*, 20*c* and 20*d* travel through nips 15*a*, 15*b*, 15*c* and 15*d* until their top (leading) edges register with edge sensors 32*a*, 32*b*, 32*c* and 32*d*, and then are printed with different color images upon energizing heads 13*a*, 13*b*, 13*c* and 13*d* in successive printing cycles.

Typically, drums 14*a*, 14*b*, 14*c* and 14*d* are driven drums, and pinch rollers 28*a*, 28*b*, 28*c* and 28*d* are idler rollers in pressure contact directly therewith, or indirectly through sheets 20*a*, 20*b*, 20*c* and 20*d*, when present therebetween. However, the drums may be idler drums and the pinch rollers may be driven rollers, in which case the pinch rollers are correspondingly connected to conveying motors 30*a*, 30*b*, 30*c* and 30*d* via linkages 31*a*, 31*b*, 31*c* and 31*d*.

Device 10 is provided with dye bearing webs 40*a*, 40*b*, 40*c* and 40*d*, specially formed in accordance with the invention, and wound as rolls on associated payout spools 41*a*, 41*b*, 41*c* and 41*d*. Payout spools 41*a*, 41*b*, 41*c* and 41*d* are located at the upstream sides of heads 13*a*, 13*b*, 13*c* and 13*d* for web payout and corresponding travel along path portions 25*a*, 25*b*, 25*c* and 25*d* through nips 15*a*, 15*b*, 15*c* and 15*d*, followed by takeup as used wound rolls on takeup spools 42*a*, 42*b*, 42*c* and 42*d*. Typically, webs 40*a*, 40*b*, 40*c* and 40*d* are interposed between sheets 20*a*, 20*b*, 20*c* and 20*d*, and heads 13*a*, 13*b*, 13*c* and 13*d*, at nips 15*a*, 15*b*, 15*c* and 15*d*, and are moved from payout spools 41*a*, 41*b*, 41*c* and 41*d* under the controlled pulling action of takeup spools 42*a*, 42*b*, 42*c* and 42*d*.

For this purpose, takeup spools 42*a*, 42*b*, 42*c* and 42*d* are driven (indexed) in concordantly controlled manner by the corresponding takeup motors 43*a*, 43*b*, 43*c* and 43*d* via the associated linkages 44*a*, 44*b*, 44*c* and 44*d* (shown schematically in FIG. 1). However, it is to be understood that other means may be used to move webs 40*a*, 40*b*, 40*c* and 40*d* through nips 15*a*, 15*b*, 15*c* and 15*d* in concordantly controlled manner.

In conjunction with this controlled movement of webs 40*a*, 40*b*, 40*c* and 40*d*, the light emitters 45*a*, 45*b*, 45*c* and 45*d* are provided adjacent one surface of the corresponding webs, and the associated light detectors 46*a*, 46*b*, 46*c* and 4*d* are provided adjacent the opposite surface of such webs. Detectors 46*a*, 46*b*, 46*c* and 46*d* are signal generating detectors correspondingly responsive to emitters 45*a*, 45*b*, 45*c* and 45*d*, and are connected to the counters 47*a*, 47*b*, 47*c* and 47*d* by associated signal lines 48*a*, 48*b*, 48*c* and 48*d* (shown in dashed line in FIG. 1). The operation of emitters 45*a*, 45*b*, 45*c* and 45*d*, detectors 46*a*, 46*b*, 46*c* and 46*d*, and counters 47*a*, 47*b*, 47*c* and 47*d*, is later described.

Stations 12*a*, 12*b*, 12*c* and 12*d* are arranged along path 25 in increments of a common station length 80 conforming to the modular nature of modules 11*a*, 11*b*, 11*c* and 11*d*. Station length 80 includes the length of a sheet 20 from its top edge to its bottom edge, and any extra distance between the sheet top edge and the station downstream (leading) end plus any extra distance between the sheet bottom edge and the station upstream (trailing) end.

At the start of a printing cycle, when sheets 20*a*, 20*b*, 20*c* and 20*d* are at stations 12*a*, 12*b*, 12*c* and 12*d*, the sheet top edges register with edge sensors 32*a*, 32*b*, 32*c* and 32*d*. Pinch rollers 28*a*, 28*b*, 28*c* and 28*d* are positioned in contact with drums 14*a*, 14*b*, 14*c* and 14*d* so that when the sheet top edges register with the edge sensors, the print area top margins of sheets 20*a*, 20*b*, 20*c* and 20*d* register with nips 15*a*, 15*b*, 15*c* and 15*d*.

In terms of the sheet top edge registration with the edge sensors, and depending on whether station length 80 includes extra distance between the sheet top edge and station downstream end and/or between the sheet bottom edge and station upstream end, at the start of a cycle the downstream end of station length 80 at each station is either at or slightly downstream of its edge sensor along path 25. For second, third and fourth stations 12*b*, 12*c* and 12*d*, the upstream end of station length 80 is either at or slightly upstream of the preceding edge sensor 32*a*, 32*b* and 32*c*. For first station 12*a*, the upstream end of station length 80 is either at or slightly downstream of tray 21 and/or reload sensor 26. This offset relation of station length 80 at stations 12*a*, 12*b*, 12*c* and 12*d* is shown by the scalar designations along the top of FIG. 1.

As also shown by such scalar designations, intermediately located in each station length 80 and within the sheet length is a dye bearing area first length 81 and a dye-free area second length 82. First length 81 and second length 82 form a metering increment third length 83 of a given web 40*a*, 40*b*, 40*c* and 40*d*. First length 81, second length 82 and third length 83 are discussed later.

The sheet print area of predetermined length between the top and bottom margins of each sheet normally corresponds to dye bearing area first length 81. As further shown by such scalar designations, downstream length 87 corresponds to the length between the sheet print area top margin and the sheet top edge, plus any extra distance between the sheet top edge and the downstream end of the station. Since the remainder of metering increment third length 83 is formed of dye-free area second length 82, the sum of dye-free area second length 82 and upstream length 88 corresponds to the length between the sheet print area bottom margin and the sheet bottom edge, plus any extra distance between the sheet bottom edge and the upstream end of the station.

First station 12*a* has a yellow dye bearing web 40*a* mounted between spools 41*a* and 42*a* for use at head 13*a*. Second station 12*b* has a magenta dye bearing web 40*b* mounted between spools 41*b* and 42*b* for use at head 13*b*. Third station 12*c* has a cyan dye bearing web 40*c* mounted between spools 41*c* and 42*c* for use at head 13*c*. Fourth station 12*d* has a black dye bearing web 40*d* mounted between spools 41*d* and 42*d* for use at head 13*d*.

At the start of a printing run, in the normal operation of a multicolor printer such as device 10, heads 13*a*, 13*b*, 13*c* and 13*d* are in spaced position and webs 40*a*, 40*b*, 40*c* and 40*d* are in registry therewith. A first sheet 20 is fed from tray 21 by feed roller 22 and advanced by upstream rollers 27*a* and drum 14*a* until its top (leading) edge is sensed by edge sensor 32*a*, thereby registering the top margin of the sheet print area with head 13*a* at nip 15*a*. Head 13*a* is then moved to contact position for a first printing cycle by energizing the head while conveying the sheet and web 40*a* in unison at proper uniform linear speed past the head to transfer yellow dye images from the web to the sheet print area.

During the first cycle, the sheet is progressively fed to downstream rollers 29*a* and in turn advanced from station 12*a* to station 12*b*, being conveyed by upstream rollers 27*b* and drum 14*b* until its top edge is sensed by edge sensor 32*b*, for registering the top margin of the same sheet print area with head 13*b* at nip 15*b*. Head 13*a* is then moved to spaced position.

In the second cycle, a second sheet 20 is fed by feed roller 22 to station 12*a* as above described, whereupon heads 13*a* and 13*b* are moved to contact position. Printing is effected by energizing heads 13*a* and 13*b* while conveying the first sheet and web 40*b* in unison at proper speed past head 13*b* and the second sheet and web 40*a* in unison at proper speed past head 13*a*. In this way, magenta dye images are transferred from web 40*b* to the same sheet print area of the first sheet, while yellow dye images are transferred from web 40*a* to the sheet print area of the second sheet.

The third and fourth cycles are effected in analogous manner by successively including first head 13*c* and web 40*c* to transfer cyan dye images from web 40*c* to the sheet print area of each sheet in turn at station 12*c*, and then head 13*d* and web 40*d* to transfer black dye images from web 40*d* to the sheet print area of each sheet in turn at station 12*d*. A set of four successive printing cycles is thus used to transfer dye images of each of the four colors of the webs at the four stations to the same print area of a sheet.

However, as each sheet is printed in turn at four stations by a set of four successive cycles in staggered manner to provide a completed print product, the multicolor printing arrangement is subject to the problem of one of the four dye bearing webs reaching an end of roll (empty) condition during a printing operation. As a practical matter, the run must be aborted to replace the empty web payout spool with a fresh one, discarding the partially printed sheets at the four stations. Then, the run must be restarted with a new set of four successive cycles for each new sheet.

This problem is avoided by providing the end of web responsive control system using specially formed dye bearing webs according to the invention in a multiweb printer such as device 10.

Figure 2:
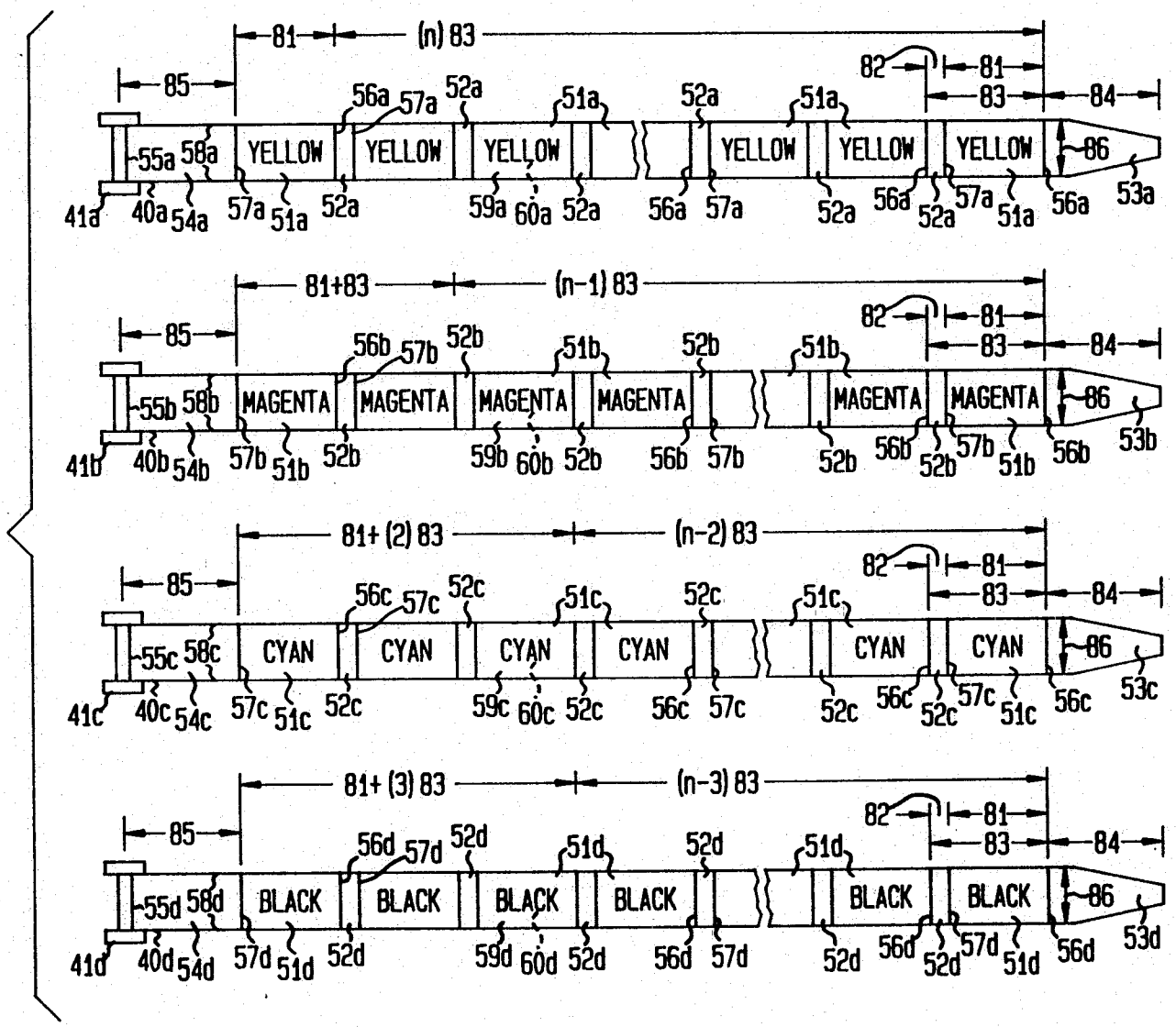
FIG. 2 is a schematic view of four different color dye bearing webs of one type usable in the device of FIG. 1.

Referring now to FIG. 2, there are shown the webs 40*a*, 40*b*, 40*c* and 40*d* correspondingly affixed to the payout spools 41*a*, 41*b*, 41*c* and 41*d*, and having the dye bearing areas 51*a*, 51*b*, 51*c* and 51*d*, the dye-free areas 52*a*, 52*b*, 52*c* and 52*d*, the leading ends 53*a*, 53*b*, 53*c* and 53*d*, the trailing ends 54*a*, 54*b*, 54*c* and 54*d*, the fixation points 55*a*, 55*b*, 55*c* and 55*d*, the leading margins 56*a*, 56*b*, 56*c* and 56*d*, the trailing margins 57*a*, 57*b*, 57*c* and 57*d*, the side edges 58*a*, 58*b*, 58*c* and 58*d*, the top sides 59*a*, 59*b*, 59*c* and 59*d*, the bottom sides 60*a*, 60*b*, 60*c* and 60*d*, and the concordantly demarked common dye bearing area first lengths 81, dye-free area second lengths 82, metering increment third lengths 83, leader lengths 84, trailer lengths 85 and transverse widths 86.

Web 40*a* is a specially formed longitudinal dye transfer web having a predetermined number of longitudinally successive thermal transfer dye bearing areas (frames, patches) 51*a* of constant first length 81 disposed therealong, and longitudinally intervening dye-free areas 52*a* of constant second length 82. Dye-free areas 52*a* are disposed along web 40*a* to delimit longitudinally the successive dye-bearing areas 51*a*. A dye bearing area 51*a* and adjacent dye-free area 52*a* together define a metering increment of constant third length 83 equal to the sum of first length 81 and second length 82. All dye areas 51*a* are of the same color, i.e., yellow.

Web 40*a* has a leader end 53*a* of selective leader length 84 that precedes the first dye bearing area 51*a* for mounting the web on takeup spool 42*a* at station 11*a*. Web 40*a* has a trailer end 54*a* of predetermined trailer length 85 that succeeds the last dye bearing area 51*a* and that spaces the last dye bearing area from a fixation point 55*a* which the web is affixed to payout spool 41*a*.

Each dye bearing area 51*a* has a leading margin 56*a* and a trailing margin 57*a*, so that the second length 82 of each dye-free area 52*a* is bounded between the trailing margin 57*a* of a preceding dye area 51*a* and leading margin 56*a* of a succeeding dye area 51*a*. Web 40*a* has opposed side longitudinal side edges 58*a*, a top surface 59*a*, a bottom surface 60*a*, and a selective transverse width 86.

Webs 40*b*, 40*c* and 40*d*, affixed to the associated payout spools 41*b*, 41*c* and 41*d*, have the same parts as web 40*a*, correspondingly designated dye bearing areas 51*b*, 51*c* and 51*d* of first length 81, dye-free areas 52*b*, 52*c* and 52*d* of second length 82, together forming metering increments of third length 83, leading ends 53*b*, 53*c* and 53*d* of leader length 84, trailing ends 54*b*, 54*c* and 54*d* of trailer length 85, fixation points 55*b*, 55*c* and 55*d*, leading margins 56*b*, 56*c* and 56*d*, trailing margins 57*b*, 57*c* and 57*d*, side edges 58*b*, 58*c* and 58*d*, top surfaces 59*b*, 59*c* and 59*d*, bottom surfaces 60*b*, 60*c* and 60*d*, and web widths 86.

However, webs 40*b*, 40*c* and 40*d* differ from web 40*a* in that web 40*b* has magenta dye bearing areas 51*b* for use at station 12*b*, web 40*c* has cyan dye bearing areas 51*c* for use at station 12*c*, and web 40*d* has black dye bearing areas 51*d* for use at station 12*d*. All dye areas of a web are of the same color, which is independent of (different from) the color of the dye areas of each other web.

While first length 81, second length 82 and third length 83 are common to webs 40*a*, 40*b*, 40*c* and 40*d*, given the modular nature of modules 11*a*, 11*b*, 11*c* and 11*d*, the leader length 84, trailer length 85 and width 86 of each web may differ from those of the other webs, so long as this does not adversely affect the modular operation of the printing cycles at stations 12*a*, 12*b*, 12*c* and 12*d*.

The leader length 84 of a given web need only be sufficiently long to mount the web on its takeup spool so that the first dye bearing area of the web can register with the corresponding head. The trailer length 85 of a given web need only be sufficiently long for the last successive dye bearing area of the web to complete its travel past the corresponding head with the completion of a given last printing cycle, as discussed below. The width 86 of a given web need only be sufficiently wide for transfer of dye images across the pertinent transverse width of the sheet print area to be serviced by the web at the corresponding printing station.

The leader and trailer lengths may vary from station to station, in conformity with the corresponding distance of the payout and takeup spools from the given printing nip. The width of the web may vary from station to station, in conformity with the corresponding dimension of the given head in transverse spanning relation across the sheet print area width, e.g., as in the case of a line printer type thermal printing head as earlier discussed.

On the other hand, as the station length 80 (FIG. 1) must be the same at each station for successive sets of printing cycles on the same sheet at the four stations, in order to print images on a common length sheet print area at each station, first length 81, second length 82 and third length 83 must be common to all webs for proper transfer of dye from the dye bearing areas of each web at each station to the same sheet print area.

As is clear from FIG. 2, all dye bearing areas and adjacent dye-free areas of each web are respectively identical in length. The sum of these two lengths, i.e. first length 81 and second length 82, equals third length 83, which represents a metering increment for advancing (indexing) each web in a printing cycle. First length 81, which demarks the common length between the leading and trailing margins of each dye bearing area, corresponds to the common length between the top and bottom margins of the print area of each sheet. In each printing cycle, a dye bearing area of a given web coincides with the print area of a given sheet during common travel past the head of a given station.

Second length 82 is a short control length to indicate the end of a printing cycle when the next successive dye-free area of a web is ready to reach the associated head. At this point, after the head is moved to spaced position, the next dye bearing area is indexed to register it with the head, and the next sheet is indexed to register its print area with such head, whereupon the head is moved to contact position to effect the next printing cycle.

As each web only moves a first length 81 equal to a dye bearing area per cycle, there is no need for complex and costly means to decrease progressively the rotational speed of its takeup spool relative to that of its platen drum to compensate for the increasing web radius on the takeup spool. Also, on indexing each web a second length 82 from a dye-free area at the end of one cycle to the next dye bearing area for starting the next cycle, the pulling action of its takeup spool inherently removes any web wrinkles caused in the prior cycle by contact with its head. This avoids the need for complex and costly wrinkle removing means.

The number of dye bearing areas and intervening dye-free areas on each web may vary from the number thereof on the other webs, as this only determines the number of printing cycles for which a web can be used before reaching its end of roll condition.

In accordance with the invention, by knowing beforehand the number of dye bearing areas on each web, the printing operation can be controlled to prevent a web from reaching its end of roll condition before completion of a set of four printing cycles for the most recently fed sheet, i.e, that advanced to first printing station 12*a*. For this purpose, as shown in FIG. 1, emitters 45*a*, 45*b*, 45*c* and 45*d*, detectors 46*a*, 46*b*, 46*c* and 46*d*, and counters 47*a*, 47*b*, 47*c* and 47*d*, are correspondingly provided.

Emitter 45*a* emits light onto the successive dye bearing areas 51*a* and dye-free areas 52*a*, as web 40*a* is incrementally conveyed from payout spool 41*a* to takeup spool 42*a* during printing cycles. Detector 46*a* individually detects the light emitted onto each dye bearing area 51*a* and each dye-free area 52*a*, and generates corresponding signals that are counted by counter 47*a*.

Each of emitters 45*b*, 45*c* and 45*d* correspondingly emits light onto the successive dye bearing areas 51*b*, 51*c* and 51*d* and dye-free areas 52*b*, 52*c* and 52*d*, as webs 40*b*, 40*c* and 40*d* are incrementally conveyed from payout spools 41*b*, 41*c* and 41*d* to takeup spools 42*b*, 42*c* and 42*d* during the cycles. Each of detectors 46*b*, 46*c* and 46*d* individually detects the light emitted onto each of dye bearing areas 51*b*, 51*c* and 51*d* and each of dye-free areas 52*b*, 52*c* and 52*d*, and generates corresponding signals that are counted by counters 47*b*, 47*c* and 47*d*.

The emitter, detector and counter at each station may operate independently of those at each other station.

As contemplated herein, an "additive primary" color is blue, green or red, which when combined (added together) produce white.

As contemplated herein, a "subtractive primary" color is yellow, magenta or cyan, yellow being composed of green and red (after subtracting blue from white), magenta being composed of blue and red (after subtracting green from white), and cyan being composed of blue and green (after subtracting red from white).

As contemplated herein, a "complementary" color is one which when combined with (added to) a given color produces white. Thus, white is produced on combining yellow with its complementary color blue, or on combining magenta with its complementary color green, or on combining cyan with its complementary color red.

Each emitter may be a light source of known type such as a blue, yellow, red or white light emitting diode (LED), e.g., of gallium-arsenide-phosphide, having high intensity (80 mCd min.) and being tightly focused (12 degrees=½ power). The emitter must emit a light beam capable of producing a first type light when directed onto a dye bearing area of the given web, and of producing a second type light (different from the first type light) when directed onto a dye-free area of the same web.

For example, the emitted light may be of a specific color such as a color complementary to the color of the dye bearing areas of the given web. Thus, emitter 45*a* may emit blue light which is complementary to the yellow dye of web 40*a*, emitter 45*b* may emit green light which is complementary to the magenta dye of web 40*b*, emitter 45*c* may emit red light which is complementary to the cyan dye of web 40*c*, and emitter 45*d* may emit white light which is complementary to (the opposite of) the black dye of web 40*d*.

Since the dye bearing areas inherently act as light filters, the emitted light directed onto a dye bearing area is reduced in intensity to produce a first type light of reduced intensity. Since the dye-free areas lack any dye, the produced second type light is roughly of the same intensity as the emitted light.

The associated detector may be any known light detector such as a silicon photoresistor, e.g., saturating at 250 nW per cubic centimeter at 930 nM light. The detector must be capable of individually detecting the produced first type light and the produced second type light, and of generating a first type signal on detecting the first type light and a second type signal on detecting the second type light. Typically, the signals are logic signals, such as a 1 ("on") first type signal, and a 0 ("off") second type signal. The signals may be generated on the basis of the difference in the intensity of the light, since the first type light is reduced in intensity by the filtering action of the dye bearing areas while the second type light is generally unmodified in intensity in that the dye-free areas lack such dye.

In this regard, these light emitters and associated detectors are analogous to the light emitters and associated detectors used in the multicolor web equipped single printing head arrangement of said commonly assigned U.S. Pat. No. Re. 33,260 (Stephenson).

Any of the emitters may be a white light source having a color filter to modify the light so as to emit light of a desired specific color. For instance, emitter 45*a* may be a white light source with a blue filter so that the emitted filtered light is blue light. Also, since the detectors can function on the basis of the difference in the intensity of the produced first type light and second type light, as noted above, all of the light sources may emit white light. In this case, the detectors will be individually selected to detect the reduced level of intensity of the emitted light after being filtered by the given color dye bearing areas of the corresponding webs, while all will detect the intensity of the white light when directed onto the dye-free areas of the webs.

Indeed, for black web 40*d*, emitter 45*d* may emit white light or light of any color since the black dye of dye bearing areas 51*d* acts in known manner as a neutral density filter. This generally reduces the transmission uniformly throughout the color spectrum so that the emitted light is correspondingly uniformly reduced in intensity. In this case, the first type light is low intensity light of unchanged color, and the second type light is the original intensity and original color emitted light.

Moreover, all the detectors may have a common threshold intensity level, below which the reduced intensity light from any color web, regardless of its particular level of reduced intensity, is detected as the first type light, and above which the original intensity light is detected as the second type light. This permits exchangeable use of any color web at any station.

The associated counter may be any known counter capable of individually counting the first type signals and/or second type signals of the detector. These counters are typically part of the circuitry of a computer processing unit programmed in conventional manner to provide an ongoing cumulative count of such signals as obtained for each web. As the signals for each web are counted, the cumulative count provides an ongoing indication of the number of used dye bearing areas, i.e., that already have been subjected to a printing cycle, and the remaining number of unused dye bearing areas, i.e., that have not yet been subjected to a printing cycle.

Figure 3:
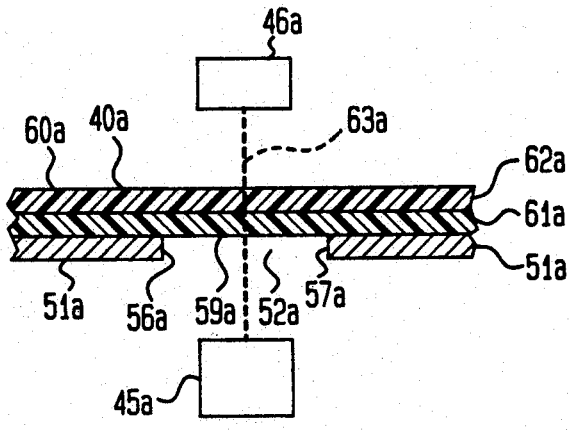
FIG. 3 is a partial sectional view of a portion of the first successive web shown in FIG. 1, indicating one light emitter and light detector arrangement thereat.

Referring now to FIG. 3, there is shown a sectional portion of a dye bearing web 40*a* with dye bearing areas 51*a*, a dye-free area 52*a*, a leading margin 56*a*, a trailing margin 57*a*, a top side 59*a*, a bottom side 60*a*, a film 61*a*, and a layer 62*a*, plus an emitter 45*a*, a detector 46*a*, and a light beam 63*a*.

FIG. 3 shows web 40*a*, emitter 45*a* and detector 46*a* at station 12*a*. Web 40*a* has a substrate film 61*a* with a slip layer 62*a* at its bottom side (inactive surface) 60*a* for engaging head 13*a* in known manner, plus dye bearing areas 51*a* and dye-free areas 52*a* on its top side (active surface) 59*a*. Each dye-free area 52*a* is located between a trailing margin 57*a* and a leading margin 56*a* on top side 59*a*. Film 61*a* and layer 62*a* are substantially optically clear components, typically strips of thin, flexible transparent polyester material, enabling a light beam 63*a* (shown schematically in FIG. 3) to travel from emitter 45*a* as light source through film 61*a* and layer 62*a* to detector 46*a* for sensing and detecting.

When light beam 63*a* is emitted from emitter 45*a* and travels through web 40*a* from active surface 59*a* to inactive surface 60*a* at a yellow dye bearing area 51*a*, the beam is reduced in intensity, as discussed above, and the reduced intensity light is sensed and detected by detector 46*a* as the first type light. When the beam 63*a* travels through web 40*a* at a dye-free area 52*a*, it is unmodified and is sensed and detected as the second type light.

Webs 40*b*, 40*c* and 40*d* are formed in the same way as web 40*a* as shown in FIG. 3, except for their respectively different color dye bearing areas 51*b*, 51*c* and 51*d*. The sensing and detecting of their emitted light is correspondingly effected, as discussed above.

Figure 4:
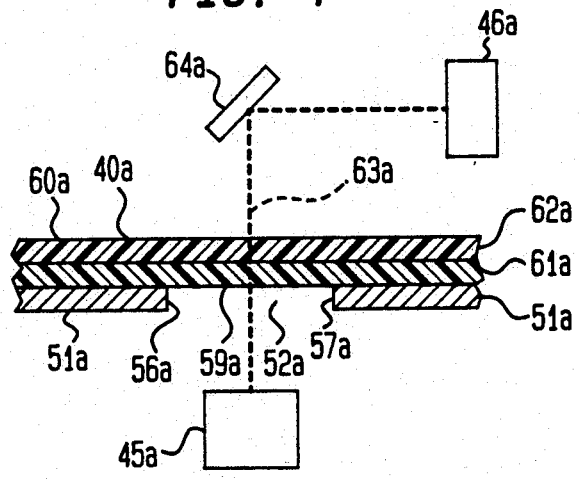
FIG. 4 is a view similar to FIG. 3, indicating another light emitter and light detector arrangement.

Referring now to FIG. 4, there is shown a sectional portion of a dye bearing web 40*a* having dye bearing areas 51*a*, a dye-free area 52*a*, a leading margin 56*a*, a trailing margin 57*a*, a top side 59*a*, a bottom side 60*a*, a film 61a, and a layer 62a, plus an emitter 45a, a detector 46a, a light beam 63a and a reflector 64a.

FIG. 4 shows a modified embodiment of the same parts as in FIG. 3, and operating in the same way, except that a light reflector 64a is provided to reflect light beam 63a, after it emerges from inactive surface 60a of web 40a, onto detector 46a. In this embodiment, detector 46a is positioned at an angle to the direction of the light emitted from emitter 45a to accommodate the detector in a confined space at station 12a. The arrangement of FIG. 4 may also be used for webs 40b, 40c and 40d.

Figure 5:
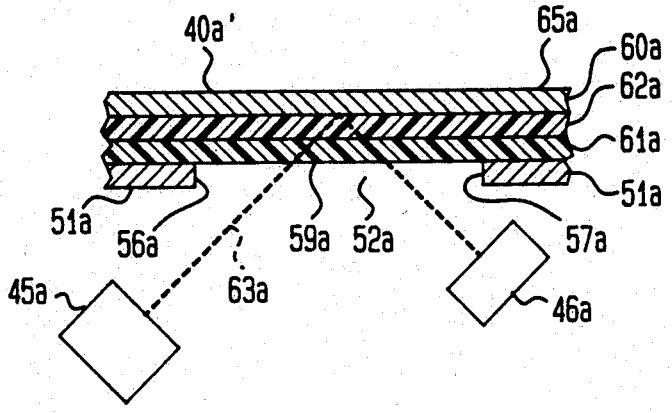
FIG. 5 is a view similar to FIG. 3, indicating an alternate type of dye bearing web and a further light emitter and light detector arrangement.

Referring now to FIG. 5, there is shown a sectional portion of a dye bearing web 40a' having dye bearing areas 51a, a dye-free area 52a, a leading margin 56a, a trailing margin 57a, a top side 59a, a bottom side 60a, a film 61a, a layer 62a and a coating 65a, plus an emitter 45a, a detector 46a and a light beam 63a.

FIG. 5 shows another modified embodiment of the same parts as in FIG. 3, and operating in the same way, except that web 40a is modified as web 40a' in that inactive surface 60a has a light reflecting (opaque) coating 65a, e.g., a permanent black dye, and emitter 45a and detector 46a are angularly positioned adjacent active surface 59a of web 40a'. In this embodiment, beam 63a emitted by emitter 45a passes from active surface 59a through web 40a' at an angle of incidence, is reflected by coating 65a on inactive surface 60a and then emerges from active surface 59a at an angle of reflection for sensing and detection by detector 46a.

When beam 63a is reflected from coating 65a through a dye bearing area 51a, it is reduced in intensity in the same way as earlier described, and when it is reflected from coating 65a through a dye-free area 52a it is unmodified. This embodiment enables detector 46a to be placed adjacent active surface 59a rather than adjacent inactive surface 60a. The arrangement of FIG. 5 may also be used for webs 40b, 40c and 40d, i.e., modified by providing a corresponding reflecting (opaque) coating thereon.

Referring again to FIG. 2, in connection with the end of roll responsive control system of the invention, it is seen that web 40a has a predetermined number of dye bearing areas 51a equal to a number "n" of third lengths 83, i.e., (n)83, plus a first length 81 as a first station 12a allowance. As third length 83 includes first length 81, the number of first lengths 81 representing the predetermined number of dye bearing areas is the number "n" of third lengths 83 present plus a first length 81 for the last dye bearing area 51a at first station 12a.

When the last dye bearing area is reached at first station 12a, at a count equal to (n)83, as determined by the operation of emitter 45a, detector 46a and counter 47a, the remaining first length 81 as a first station 12a allowance is sufficient to complete a set of four printing cycles for the sheet then advanced to first station 12a. At the end of the last cycle of that four cycle set, i.e., at the end of roll condition of web 40a, the number of remaining dye bearing areas is zero, which corresponds to the zero number of printing heads preceding head 13a along path 25.

Web 40b has a predetermined number of dye bearing areas 51b equal to a number "n minus 1" of third lengths 83, i.e., (n−1)83, plus a first length 81 as a first station 12a allowance and a third length 83 as a second station 12b allowance. The number of first lengths 81 representing the predetermined number of dye bearing areas is the number "n−1" of third lengths 83 present plus a length 81 for the last dye bearing area 51a at first station 12a and a third length 83 for the last dye bearing area 51b at second station 12b.

When the last dye bearing area is reached at second station 12b, at a count equal to (n−1)83, as determined by the operation of emitter 45b, detector 46b and counter 47b, the remaining first length 81 as a first station 12a allowance and third length 83 as a second station 12b allowance, i.e., 81+83, are sufficient to complete a set of four printing cycles for the sheet then advanced to first station 12a. At the end of the last cycle of that four cycle set, i.e., at the end of roll condition of web 40b, the number of remaining dye bearing areas is one, which corresponds to the one printing head 13a preceding head 13b along path 25.

Web 40c has a predetermined number of dye bearing areas 51c equal to a number "n minus 2" of third lengths 83, i.e., (n−2)83, plus a first length 81 as a first station 12a allowance, a third length 83 as a second station 12b allowance and another third length 83 as a third station 12c allowance. The number of first lengths 81 representing the predetermined number of dye bearing areas is the number "n−2" of third lengths 83 present plus a length 81 for the last dye bearing area 51a at first station 12a, a third length 83 for the last dye bearing area 51b at second station 12b, and another third length 83 for the last dye bearing area 51c at third station 12c.

When the last dye bearing area is reached at third station 12c, at a count equal to (n−2)83, as determined by the operation of emitter 45c, detector 46c and counter 47c, the remaining first length 81 as a first station 12a allowance, third length 83 as a second station 12b allowance, and third length 83 as a third station 12c allowance, i.e., 81+(2)83, are sufficient to complete a set of four printing cycles for the sheet then advanced to first station 12a. At the end of the last cycle of that four cycle set, i.e., at the end of roll condition of web 40c, the number of remaining dye bearing areas is two, which corresponds to the two printing heads 13a and 13b preceding head 13c along path 25.

Web 40d has a predetermined number of dye bearing areas 51d equal to a number "n minus 3" of third lengths 83, i.e., (n−3)83, plus a first length 81 as a first station 12a allowance, a third length 83 as a second station 12b allowance, another third length 83 as a third station 12c allowance, and still another third length 83 as a fourth station 12d allowance. The number of first lengths 81 representing the predetermined number of dye bearing areas is the number "n−3" of third lengths 83 present plus a length 81 for the last dye bearing area 51a at first station 12a, a third length 83 for the last dye bearing area 51b at second station 12b, another third length 83 for the last dye bearing area 51c at third station 12c, and still another third length 83 for the last dye bearing area 51d at fourth station 12d.

When the last dye bearing area is reached at fourth station 12d, at a count equal to (n−3)83, as determined by the operation of emitter 45d, detector 46d and counter 47d, the remaining first length 81 as a first station 12a allowance, third length 83 as a second station 12b allowance, third length 83 as a third station 12c allowance, and third length 83 as a fourth station 12d allowance, i.e., 81+(3)83, are sufficient to complete a set of four printing cycles for the sheet then advanced to first station 12a. At the end of the last cycle of that four cycle set, i.e., at the end of roll condition of web 40d, the number of remaining dye bearing areas is three which corresponds to the three printing heads 13*a*, 13*b* and 13*c* preceding head 13*d* along path 25.

Figure 6:
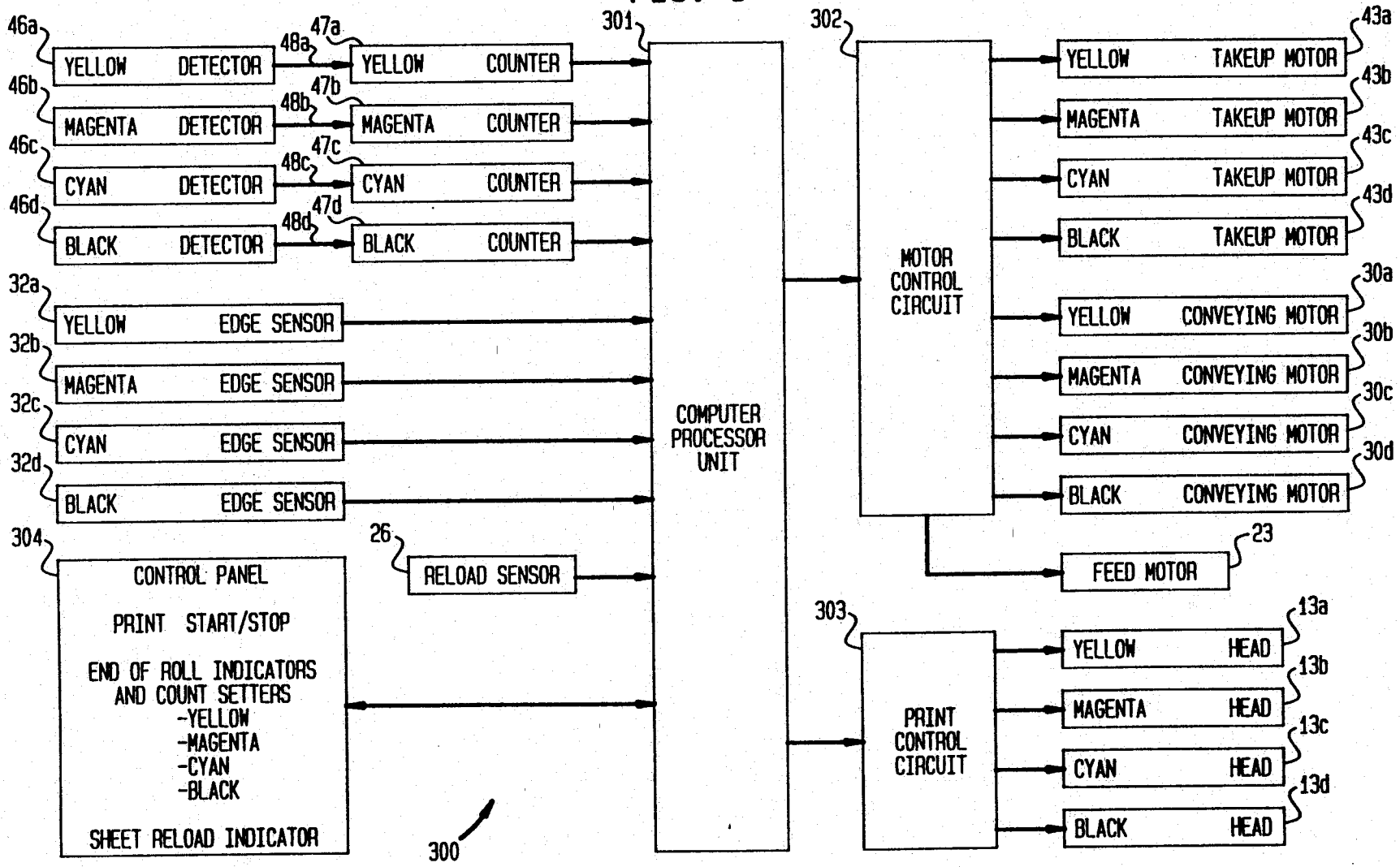
FIG. 6 is a schematic view of a control system for controlling the operation of the device in accordance with the invention.

Referring now to FIG. 6, there is shown a control means 300, a computer processing unit 301, a motor control circuit 302, a print control circuit 303, a control panel 304, heads 13*a*, 13*b*, 13*c* and 13*d*, a feed motor 23, a reload sensor 26, conveying motors 30*a*, 30*b*, 30*c* and 30*d*, edge sensors 32*a*, 32*b*, 32*c* and 32*d*, takeup motors 43*a*, 43*b*, 43*c* and 43*d*, detectors 46*a*, 46*b*, 46*c* and 46*d*, counters 47*a*, 47*b*, 47*c* and 47*d*, and signal lines 48*a*, 48*b*, 48*c* and 48*d*.

Control means 300 has a computer processing unit (CPU) 301 to control the operation of device 10 of FIG. 1 for automatically effecting successive cycle printing runs as earlier described. CPU 301 is programmed in conventional manner to control the operation of a motor control circuit 302 and a print control circuit 303, in conjunction with a self-explanatory control panel 304.

Control means 300 is analogous to the control means used in conjunction with the light emitters and detectors for operating the multicolor web equipped single printing head arrangement of said commonly assigned U.S. Pat. No. Re. 33,260 (Stephenson).

Detectors 46*a*, 46*b*, 46*c* and 46*d* are connected to counters 47*a*, 47*b*, 47*c* and 47*d* via signal lines 48*a*, 48*b*, 48*c* and 48*d* to count the successive individual instances of generated signals responsive to the detected dye bearing areas and dye free areas of webs 40*a*, 40*b*, 40*c* and 40*d*. Counters 46*a*, 46*b*, 46*c* and 46*d* are connected to input the counts to CPU 301. Typically, the counters form part of the circuitry of CPU 301, and are programmed to restart a count at the time a given web is mounted at its station with the first dye bearing area thereof in registry with the associated head.

As each dye bearing area is counted, CPU 301 provides an ongoing total of the number of unused dye bearing areas on each web. As each dye-free area is counted, CPU 301 is given an indication of the completion of a printing cycle, for automatically moving each head to spaced position, indexing each web to the next dye bearing area, and indexing each sheet to the next station. When the next dye bearing area is counted, this indicates that the given web has been properly indexed to register that dye bearing area with its associated head for the next cycle.

Edge sensors 32*a*, 32*b*, 32*c* and 32*d* are connected to CPU 301 to signal the location thereat of the sheets consequent such sheet indexing, thereby indicating that each sheet has been properly indexed to register its print area with the head at each station.

When each next dye bearing area and corresponding sheet are in registry with the associated head, the heads are moved to contact position to effect the next cycle automatically.

Reload sensor 26 is connected to CPU 301 to indicate an "empty" sheet condition of tray 21 in known manner.

Motor circuit 302 controls the operation of takeup motors 43*a*, 43*b*, 43*c* and 43*d* to move webs 40*a*, 40*b*, 40*c* and 40*d* past heads 13*a*, 13*b*, 13*c* and 13*d* in respective metering increments of third length 83. Motor circuit 302 also controls the operation of feed motor 23 and conveying motors 30*a*, 30*b*, 30*c* and 30*d* to advance successive sheets 20 to edge sensors 32*a*, 32*b*, 32*c* and 32*d*, and then to move the sheets past heads 13*a*, 13*b*, 13*c* and 13*d* in unison with the movement of webs 40*a*, 40*b*, 40*c* and 40*d* by takeup motors 43*a*, 43*b*, 43*c* and 43*d* during successive printing cycles.

Print circuit 303 controls the operation of heads 13*a*, 13*b*, 13*c* and 13*d* so as to move the heads between the spaced and contact positions, and when in contact position to energize (modulate) the heads to effect printing during the successive printing cycles.

When the approach of the last dye bearing area of any web is detected and counted, as above described, control means 300 controls the operation of the last set of four cycles that can be effected before that web reaches its end of roll condition. This allows device 10 to complete the successive printing at stations 12*a*, 12*b*, 12*c* and 12*d* of the final sheet 20 then at first station 12*a* when the last dye bearing area of any web is reached.

Specifically, control means 300 prevents further operation at first station 12*a* after that final sheet then at first station 12*a* is printed at first station 12*a*, next prevents further operation at second station 12*b* after that final sheet from first station 12*a* is printed at second station 12*b*, then prevents further operation at third station 12*c* after that final sheet from first station 12*a* is printed at third station 12*c*, and finally prevents further operation at fourth station 12*d* after that final sheet from first station 12*a* is printed at fourth station 12*d*.

The last dye bearing area is reached at first station 12*a* at a count equal to (n)83, since the remaining first length 81 as a first station 12*a* allowance is sufficient to complete a set of four printing cycles for the sheet then advanced to first station 12*a*.

The last dye bearing area is reached at second station 12*b* at a count equal to (n−1)83, since the remaining first length 81 as a first station 12*a* allowance and third length 83 as a second station 12*b* allowance, i.e., 81+83, are sufficient to complete a set of four printing cycles for the sheet then advanced to first station 12*a*.

The last dye bearing area is reached at third station 12*c* at a count equal to (n−2)83, since the remaining first length 81 as a first station 12*a* allowance, third length 83 as a second station 12*b* allowance, and third length 83 as a third station 12*c* allowance, i.e., 81+(2)83, are sufficient to complete a set of four printing cycles for the sheet then advanced to first station 12*a*.

The last dye bearing area is reached at fourth station 12*d* at a count equal to (n−3)83, since the remaining first length 81 as a first station 12*a* allowance, third length 83 as a second station 12*b* allowance, third length 83 as a third station 12*c* allowance, and third length 83 as a fourth station 12*d* allowance, i.e., 81+(3)83, are sufficient to complete a set of four printing cycles for the sheet then advanced to first station 12*a*.

In all cases, the number "n" (FIG. 2) is the total number of dye bearing areas of a given web except the last successive dye bearing area. The predetermined number of dye bearing areas on each web is that number "n" plus "1" for the last successive dye bearing area, so that the predetermined number equals "n+1".

It is to be noted that the leading end precedes the first dye bearing area on a given web, and that the first dye bearing area is normally manually registered with its associated head before the start of a printing cycle. The first dye-free area is thus counted on completing the first cycle using the first dye bearing area. Whether counting is based on the count of the dye bearing areas or the dye-free areas, or both, each printing cycle will correspond to the indexing of each web an increment corresponding to third length 83, starting with the first cycle using the first dye bearing area.

This means that on reaching the last dye bearing area, the number of used dye bearing areas is the number of indexed third lengths 83 representing all dye bearing areas present, except the last dye bearing area which lacks a succeeding dye-free area. CPU 301 is programmed to take this relationship into account in controlling the operation on the basis of the ongoing counts of used dye bearing areas in terms of the given number "n".

Advantageously, the predetermined number of dye bearing areas on each web is independent of the number thereof on each other web. Thus, any web may be used at any station of a multiweb printing device having any plurality of printing stations (heads) since its end of roll condition is responsively controlled as described above. As the number of dye bearing areas on each web is known beforehand, CPU 301 can be programmed per panel 304 to set the counters to indicate the approach of the end of roll condition of each web in dependence upon the number of remaining dye bearing areas of each web at each station needed to complete a set of printing cycles for a sheet then at the first station.

If the device has three heads at three stations, e.g., a yellow web first station, a magenta web second station and a cyan web third station, control means 300 is programmed to control the operation for a last set of three cycles on reaching an end of roll condition at any web. The end of roll condition is reached at the first station when one dye bearing area remains on the first station web. The end of roll condition is reached at the second station when two dye bearing areas remain on the second station web. The end of roll condition is reached at the third station when three dye bearing areas remain on the third station web.

If the printing device has four heads at four stations, e.g., a yellow web first station, a magenta web second station, a cyan web third station, and a black web fourth station, as shown in FIG. 1, control means 300 is programmed to control the operation for a last set of four printing cycles on reaching an end of roll condition at any web. The end of roll condition is reached at the first station when one dye bearing area remains on the first station web. The end of roll condition is reached at the second station when two dye bearing areas remain on the second station web. The end of roll condition is reached at the third station when three dye bearing areas remain on the third station web. The end of roll condition is reached at the fourth station when four dye bearing areas remain on the fourth station web.

On completing the printing of the last sheet at all stations, control means 300 suspends the run, and a signal on panel 304 indicates the end of roll condition of the given "empty" web. On replacing that web with a fresh one, the run is restarted using panel 304. In like manner, when reload sensor 26 indicates that the supply of sheets 20 is exhausted, control means 300 suspends the run after completing the printing of the last supplied sheet, and a signal on panel 304 indicates the empty state of tray 21. After reloading tray 21, the run is restarted using panel 304.

As the diameter of a web on its payout spool incrementally decreases and that on its takeup spool incrementally increases during use, the end of roll condition of the web cannot be controlled accurately by counting spool revolutions. On the other hand, the end of roll responsive system of the invention permits such accurate control for completion of a final set of cycles corresponding to the number of printing heads involved on reaching an end of roll condition for any web. This is achieved by a low cost control system using inexpensive emitters, detectors and counters in conjunction with the stated specially formed webs.

These webs are readily manufactured by conventional technique, with the predetermined number of dye bearing areas and intervening dye-free areas prefixed as constants for each web and the dye-free area spaced successive dye bearing areas applied thereto in one operation. In contrast, placing end of roll codes on the webs requires an additional manufacturing step after web fabrication.

Figure 7:
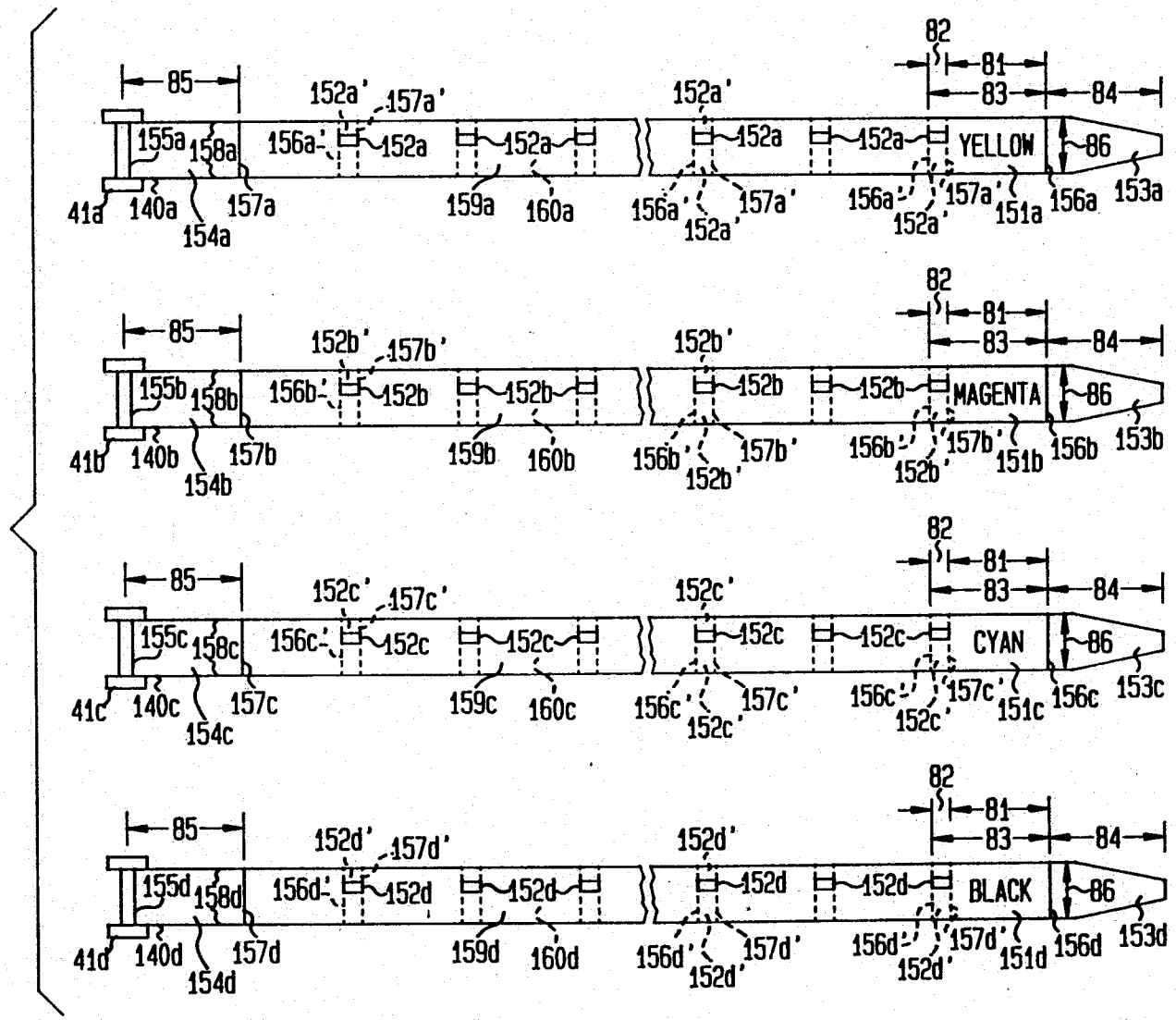
FIG. 7 is a view similar to FIG. 2 of four different color dye bearing webs of another type usable in the device of FIG. 1.

Referring now to FIG. 7, there are shown webs 140*a*, 140*b*, 140*c* and 140*d*, payout spools 41*a*, 41*b*, 41*c* and 41*d*, dye bearing areas 151*a*, 151*b*, 151*c* and 151*d*, bridging dye bearing portions 152*a*', 152*b*', 152*c*' and 152*d*', dye-free areas 152*a*, 152*b*, 152*c* and 152*d*, leading ends 153*a*, 153*b*, 153*c* and 153*d*, trailing ends 154*a*, 154*b*, 154*c* and 154*d*, fixation points 155*a*, 155*b*, 155*c* and 155*d*, leading margins 156*a*, 156*b*, 156*c*, 156*d*, 156*a*', 156*b*', 156*c*' and 156*d*', trailing margins 157*a*, 157*b*, 157*c*, 157*d*, 157*a*', 157*b*', 157*c*' and 157*d*', side edges 158*a*, 158*b*, 158*c* and 158*d*, top sides 159*a*, 159*b*, 159*c* and 159*d*, bottom sides 160*a*, 160*b*, 160*c* and 160*d*, and concordantly demarked common dye bearing area first lengths 81, dye-free area second lengths 82, metering increment third lengths 83, leader lengths 84, trailer lengths 85 and transverse widths 86.

Webs 140*a*, 140*b*, 140*c* and 140*d* of the modified embodiment of FIG. 7 and their corresponding associated parts and dimensions are identical to webs 40*a*, 40*b*, 40*c* and 40*d* and their corresponding associated parts as shown in FIG. 2, except that in FIG. 7 the webs have dye-free areas 152*a*, 152*b*, 152*c* and 152*d* which extend transversely across only a portion of the selective transverse width 86 between the side edges 158*a*, 158*b*, 158*c* and 158*d*. The remaining portion of such width at each dye-free area is provided with corresponding bridging dye bearing portions 152*a*', 152*b*', 152*c*' and 152*d*' substantially contiguous with the adjacent dye bearing areas 151*a*, 151*b*, 151*c* and 151*d* at their corresponding intermediate leading margins 156*a*', 156*b*', 156*c* and 156*d*', and intermediate trailing margins 157*a*', 157*b*', 157*c*' and 157*d*' (as shown by dashed lines in FIG. 7).

In this way, bridging dye bearing portions 152*a*', 152*b*', 152*c*' and 152*d*' correspondingly form a substantially continuous dye layer with the adjacent dye bearing areas 151*a*, 151*b*, 151*c* and 151*d* longitudinally along the top sides 159*a*, 159*b*, 159*c* and 159*d* of webs 140*a*, 140*b*, 140*c* and 140*d*, and remote from the bottom sides 160*a*, 160*b*, 160*c* and 160*d*. Each such continuous dye layer is longitudinally interrupted by the associated intervening dye-free areas 152*a*, 152*b*, 152*c* and 152*d*, thereby defining successive substantially isolated dye-free apertures (reverse frames or patches), as shown, in the continuous dye layer.

Leader ends 153*a*, 153*b*, 153*c* and 153*d*, and trailer ends 154*a*, 154*b*, 154*c* and 154*d*, demark the corresponding initial leading margins 156*a*, 156*b*, 156*c* and 156*d*, and final trailing margins 157*a*, 157*b*, 157*c* and 157*d*, of the continuous dye layers on webs 141*a*, 141*b*, 141*c* and 141*d*. The webs are affixed at the corresponding fixation points 155*a*, 155*b*, 155*c* and 155*d* to payout spools 41*a*, 41*b*, 41*c* and 41*d* in the same way as the webs of FIG. 2. Leader length 84, trailer length 85, first length 81, second length 82 and third length 83 are the same as those of the webs of FIG. 2.

The webs of FIG. 7 are manufactured in analogous manner to the webs of FIG. 2 and operate in the same manner, except that the light of the emitters is directed onto the webs at a width location to register with dye-free area apertures 152*a*, 152*b*, 152*c* and 152*d* for detection by the corresponding detectors in the stated manner.

Figure 8:
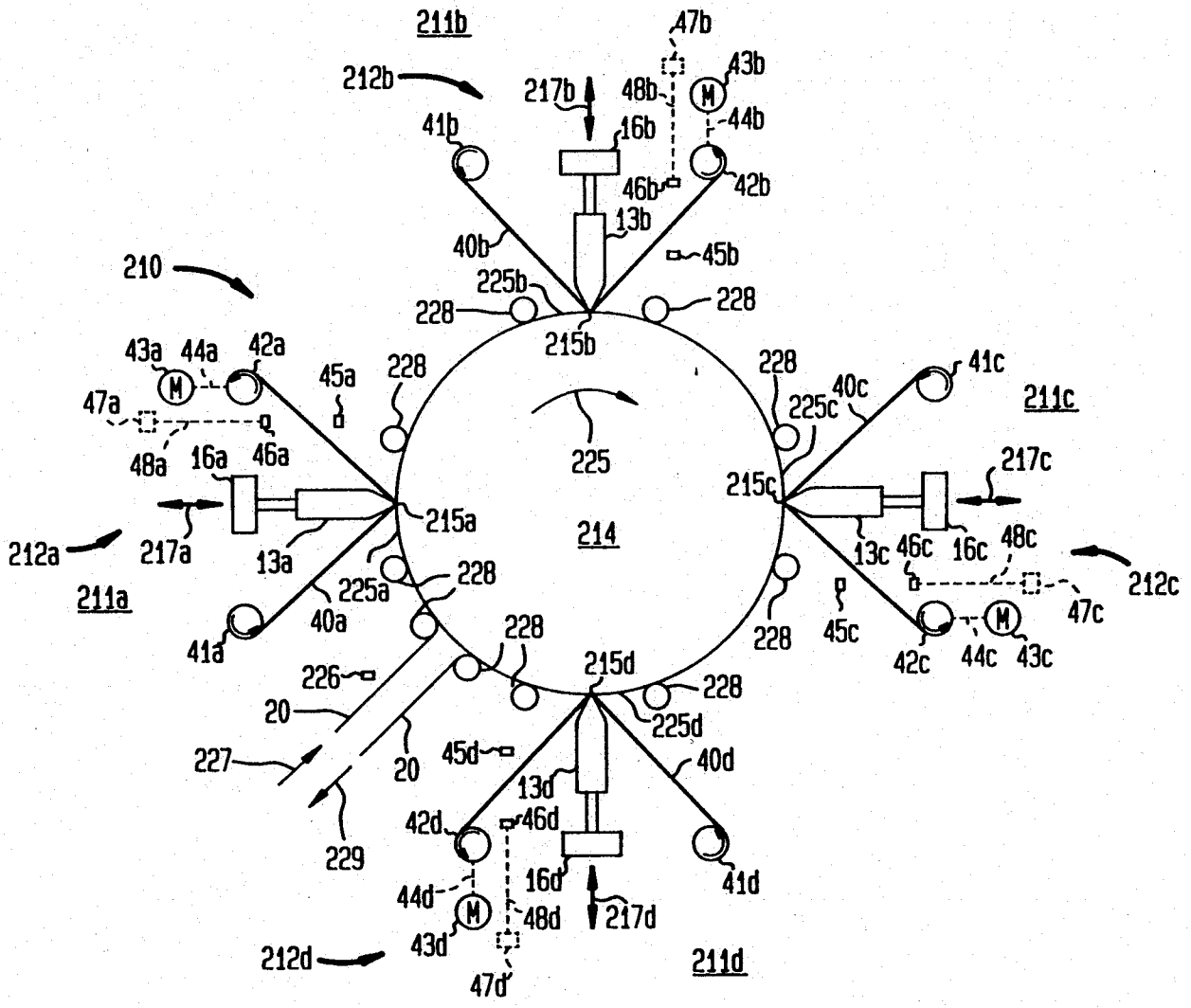
FIG. 8 is a schematic view of a thermal printing device, with four thermal heads and associated dye bearing webs arranged along a circular path to effect four color printing of individual dye receiving sheets according to another embodiment of the invention.

Referring now to FIG. 8, there is shown a thermal printing device 210 in accordance with another embodiment of the invention. Device 210 has modules 211*a*, 211*b*, 211*c* and 211*d*, stations 212*a*, 212*b*, 212*c* and 212*d*, printing heads 13*a*, 13*b*, 13*c* and 13*d*, a platen drum 214, printing nips 215*a*, 215*b*, 215*c* and 215*d*, solenoids 16*a*, 16*b*, 16*c* and 16*d*, transverse paths 217*a*, 217*b*, 217*c* and 217*d*, sheets 20, a circular path 225, path portions 225*a*, 225*b*, 225*c* and 225*d*, a reload sensor 226, an upstream direction 227, pinch rollers 228, a downstream direction 229, payout spools 41*a*, 41*b*, 41*c* and 41*d*, takeup spools 42*a*, 42*b*, 42*c* and 42*d*, takeup motors 43*a*, 43*b*, 43*c* and 43*d*, and motor linkages 44*a*, 44*b*, 44*c* and 44*d*.

Device 210 is provided with specially formed dye bearing webs 40*a*, 40*b*, 40*c* and 40*d*, plus emitters 45*a*, 45*b*, 45*c* and 45*d*, detectors 46*a*, 46*b*, 46*c* and 46*d*, counters 47*a*, 47*b*, 47*c* and 47*d*, and signal lines 48*a*, 48*b*, 48*c* and 48*d*, according to the invention.

Device 210 of FIG. 8 comprises a conventional multicolor printing system generally of the same parts and effecting the same operations as device 10 of FIG. 1. However, device 210 has a common rotatable platen drum 214, around whose circumference the successive printing modules 211*a*, 211*b*, 211*c* and 211*d* are located at angularly spaced stations 212*a*, 212*b*, 212*c* and 212*d*. The thermal heads 13*a*, 13*b*, 13*c* and 13*d* are arranged at drum 214 to form the corresponding printing nips 215*a*, 215*b*, 215*c* and 215*d*.

Heads 13*a*, 13*b*, 13*c* and 13*d* are moved by solenoids 16*a*, 16*b*, 16*c* and 16*d* along transverse (radial) paths indicated by the arrows 217*a*, 217*b*, 217*c* and 217*d*, between an inactive spaced position (not shown) and an active contact position relative to drum 214 to form nips 15*a*, 15*b*, 15*c* and 15*d* therewith, as shown, typically under slight compression.

In a given run, sheets 20 are individually fed to drum 214 from a supply thereof by means (not shown), such as from a tray by a feed roller driven by a feed motor via a drive linkage in the same way as shown in FIG. 1. During rotation of drum 214, the sheets 20 travel along a circular path indicated by the arrow 225 for advance in turn along the successive path portions 225*a*, 225*b*, 225*c* and 225*d* at stations 212*a*, 212*b*, 212*c* and 212*d*. A reload sensor 226 may be located adjacent the portion of drum 214 upstream of first station 212*a* and downstream of fourth station 212*d* to indicate the "empty" sheet condition of its supply.

During rotation of drum 214, the sheets 20 are fed thereto in an upstream direction indicated by the arrow 227, whereupon they are maintained in proper stationary contact therewith in successive commonly spaced relation by the spaced pinch rollers 228, and then exit from the drum in a downstream direction indicated by the arrow 229. Drum 214 is driven in concordant controlled manner, relative to the feeding of the sheets 20 thereto, by drive means (not shown), such as a conveying motor via a drive linkage analogously to the feeding and conveying of the sheets 20 in device 10.

Due to such concordant control, the commonly spaced successive sheets 20 are conveyed along path 225 so that they travel through nips 215*a*, 215*b*, 215*c* and 215*d* until the top (leading) margins of their print areas register with heads 13*a*, 13*b*, 13*c* and 13*d*. They are then printed with different color images, e.g., yellow, magenta, cyan and black, upon energizing the heads in successive printing cycles, in the same way as in device 10.

In the same way as in FIG. 1, device 210 is provided with dye bearing webs 40*a*, 40*b*, 40*c* and 40*d* on payout spools 41*a*, 41*b*, 41*c* and 41*d* at the upstream sides of heads 13*a*, 13*b*, 13*c* and 13*d* for web payout and corresponding travel along path portions 225*a*, 225*b*, 225*c* and 225*d* through nips 215*a*, 215*b*, 215*c* and 215*d*, followed by takeup as used wound rolls on takeup spools 42*a*, 42*b*, 42*c* and 42*d*.

Webs 40*a*, 40*b*, 40*c* and 40*d* move from payout spools 41*a*, 41*b*, 41*c* and 41*d* under the controlled pulling action of takeup spools 42*a*, 42*b*, 42*c* and 42*d*. Takeup spools 42*a*, 42*b*, 42*c* and 42*d* are driven in concordantly controlled manner by the takeup motors 43*a*, 43*b*, 43*c* and 43*d* via the linkages 44*a*, 44*b*, 44*c* and 44*d* (shown schematically in FIG. 8), in the same way as in FIG. 1.

In conjunction with the controlled movement of webs 40*a*, 40*b*, 40*c* and 40*d*, emitters 45*a*, 45*b*, 45*c* and 45*d* are provided adjacent one surface of the associated webs, and detectors 46*a*, 46*b*, 46*c* and 46*d* are provided adjacent the opposite surface of such webs. Detectors 46*a*, 46*b*, 46*c* and 46*d* are responsive to emitters 45*a*, 45*b*, 45*c* and 45*d*, and are connected to the counters 47*a*, 47*b*, 47*c* and 47*d* by the signal lines 48*a*, 48*b*, 48*c* and 48*d*. The operation of these emitters, detectors and counters is the same as in FIG. 1.

At the start of a printing cycle in device 210, the top margin of the print area of a given sheet, and the leading margin of a dye bearing area of a given web, are both initially located in registry with the head at a given station, and then the head is energized to effect a printing cycle in the same manner as in FIG. 1. The operation of device 210 is controlled by control means in analogous manner to the control of the operation of device 10. Thus, a printing run is controlled so that when an end of roll condition is reached for any web, a last set of four printing cycles is assured for printing the final sheet then at first station 212*a*.

Although the dye bearing area webs contemplated herein are typically used only once and then replaced, it is possible to provide these webs with dye bearing areas capable of repeated use. In this case, on reaching an end of roll condition, the web is rewound from its takeup spool onto its payout spool for repeat use.

The printing device used herein may have any plurality of stations, such as two, three, four or more stations, and each web may have dye bearing areas of any desired color independent of the color of the dye bearing areas of the other webs.

As contemplated herein, "dye bearing area" refers to an area containing a colored material (transfer dye) which is capable of transferring from its web as carrier to a corresponding sheet as image receiver, such as in response to energy applied thereto by the individual heating elements of a thermal printing head.

Preferably, the printing device used herein is a thermal printing device and the specially formed webs have thermal transfer dye bearing areas. However, the end of roll responsive control system of the invention is also usable with printing devices not based on thermal transfer technique, in which case the specially formed webs contemplated herein will have dye bearing areas usable to transfer images to the sheets by any other suitable technique.

The end of roll condition problem is not generally significant in a printing device with a single printing head, as only one sheet is discarded when this condition, occurs during printing. On the other hand, in a multiweb printing device, the wastage of the discarded sheet and web portion used for its partial printing, and the probability of an end of roll condition occurring during printing, are both increased by a multiple equal to the number of webs (stations). However, the end of roll responsive control system of the invention can be used in a multiweb printing device operating at only one station to print a sheet with only one color dye, e.g., black, such as when printing lines of text on a sheet in one cycle. In this case, control means 300 is programmed in known manner to effect single station printing at only one of the plurality of stations It is to be understood that sheets 20 cannot normally be fed as a continuous sheet to the first station of the printing device according to the invention, since the advancing of the next sheet portion cannot be prevented on reaching an end of roll condition. However, a continuous sheet may be used if means are provided to cut successive sheets therefrom for advance to the first station.

Accordingly, it can be appreciated that the specific embodiments described are merely illustrative of the general principles of the invention. Various modifications may be provided consistent with the principles set forth.

What is claimed is:

1. A printing device comprising:

a plurality of printing means for printing arranged in succession along a path for individual operation in succession in successive printing cycles, and comprising a first successive printing means and at least one remaining successive printing means;

advancing means for individually advancing dye receiving sheets in succession along the path to each printing means for respective printing in a respective cycle at each printing means;

each printing means having an associated longitudinal dye transfer web comprising a predetermined number of longitudinally successive transfer dye bearing areas of constant first length disposed therealong, and longitudinally intervening dye-free areas of constant second length disposed therealong to delimit longitudinally the successive dye bearing areas, so that a dye bearing area and an adjacent dye-free area together define a metering increment of constant third length equal to a sum of the first length and second length, the dye bearing areas all being of a same color and such color being independent of a same color of the dye bearing areas of the web of each other printing means;

moving means for individually moving the web of each printing means a respective said increment along the path to that printing means for dye transfer from a respective dye bearing area to a respective sheet for printing thereof in a respective cycle;

sensing and counting means for individually sensing the successive dye bearing areas and dye-free areas of the web of each printing means upon moving said areas to that printing means in said cycles, and for counting the sensed dye bearing areas and thereby indicating, relative to said predetermined number of dye bearing areas of the web of a given printing means, a number of dye bearing areas already subjected to said cycle and a number of remaining dye bearing areas not yet subjected to said cycle; and control means for controlling a cycle operation of the advancing means, printing means and moving means, and responsive to the sensing and counting means so that when said number of remaining dye bearing areas of the web of any printing means at an end of said cycle corresponds to the number of printing means preceding that printing means along the path, the control means prevents further cycle operation at the first successive printing means while permitting respective completion of the cycle operation for already advanced sheets at the remaining successive printing means.

2. The device of claim 1 wherein the control means is arranged to prevent the advancing of a sheet to the first successive printing means when the indicated number of remaining dye bearing areas of the web of any printing means at an end of said cycle corresponds to the number of printing means preceding that printing means along the path.

3. The device of claim 1 wherein each web comprises substantially non-contiguous, discrete dye bearing areas longitudinally successively spaced by the intervening dye-free areas.

4. The device of claim 1 wherein each web comprises longitudinal side edges defining a selective transverse width therebetween, each dye-free area extends transversely across a portion of said width and a remaining portion of said width is provided with a bridging dye bearing portion substantially contiguous with the dye bearing areas adjacent said dye-free area, to form a substantially continuous dye layer longitudinally along the web and longitudinally interrupted by intervening dye-free areas defining successive substantially isolated dye-free apertures in said continuous dye layer.

5. The device of claim 1 wherein the color of the dye bearing areas of each web is different from the color of the dye bearing areas of each other web.

6. The device of claim 5 wherein the color of the dye bearing areas of one web is black or one subtractive primary color and the color of the dye bearing areas of each other web is respectively a different subtractive primary color.

7. The device of claim 6 comprising three printing means and three correspondingly associated webs, the webs respectively having yellow, magenta and cyan dye bearing areas.

8. The device of claim 6 comprising four printing means and four correspondingly associated webs, the webs respectively having yellow, magenta, cyan and black dye bearing areas.

9. The device of claim 1 wherein each web comprising a substantially optically clear substrate film having an active dye transfer surface on which the dye bearing areas and dye-free areas are disposed, and an opposed inactive surface.

10. The device of claim 9 wherein the sensing and counting means comprises for each web:

a light emitter for emitting a light beam producing a first type light when the beam is directed onto one of the dye bearing areas of the web, and producing a second type light different from the first type light when the beam is directed onto a dye-free area of the web;

a light detector arranged for individually detecting the first type light and the second type light; and a counter responsive to the detector for providing a count corresponding to the successive instances of detected first type light.

11. The device of claim 9 wherein the inactive surface of each web is coated with a reflective coating for reflecting light directed onto the inactive surface through the active surface of the web; and the sensing and counting means comprises for each web;

a light emitter for emitting a light beam producing a first type reflected light when the beam is directed onto the coating through a dye bearing area on the active surface of the web, and producing a second type reflected light different from the first type reflected light when the beam is directed onto the coating through a dye-free area of the web;

a light detector arranged for individually detecting the first type reflected light and the second type reflected light; and a counter responsive to the detector for providing a count corresponding to the successive instances of detected first type reflected light.

12. The device of claim 11 wherein the coating comprises a black dye.

13. The device of claim 1 wherein each printing means comprises a printing head for its associated web, and the moving means are controlled by the control means to move each web a said increment to register a next successive dye bearing area thereof with its corresponding head for a next respective cycle.

14. A printing device comprising:

a plurality of printing means for printing arranged in succession along a path for individual operation in succession in successive printing cycles, and comprising a first successive printing means and at least one remaining successive printing means;

advancing means for individually advancing dye receiving sheets in succession along the path to each printing means for respective printing in a respective cycle at each printing means;

each printing means having an associated longitudinal dye transfer web comprising a predetermined number of longitudinally successive transfer dye bearing areas of constant first length disposed therealong, and longitudinally intervening dye-free areas of constant second length disposed therealong to delimit longitudinally the successive dye bearing areas, so that a dye bearing area and an adjacent dye-free area together define a metering increment of constant third length equal to a sum of the first length and second length, the dye bearing areas all being of a same color and such color being independent of a same color of the dye bearing areas of the web of each other printing means;

moving means for individually moving the web of each printing means a respective said increment along the path to that printing means for dye transfer from a respective dye bearing area to a respective sheet for printing thereof in a respective cycle;

sensing and counting means for individually sensing the successive dye bearing areas and dye-free areas of the web of each printing means upon moving said areas to that printing means in said cycles, and for counting the sensed dye bearing areas and thereby indicating, relative to said predetermined number of dye bearing areas of the web of a given printing means, a number of dye bearing areas already subjected to said cycle and a number of remaining dye bearing areas not yet subjected to said cycle; and control means for controlling a cycle operation of the advancing means, printing means and moving means, and responsive to the sensing and counting means so that when said number of remaining dye bearing areas of the web of any printing means at an end of said cycle corresponds to the number of printing means preceding that printing means along the path, the control means prevents further cycle operation at the first successive printing means while permitting respective completion of the cycle operation for already advanced sheets at the remaining successive printing means;

wherein each printing means comprises a printing head for its associated web, and the moving means area controlled by the control means to move each web a said increment to register a next successive dye bearing area thereof with its corresponding head for a next respective cycle;

the printing device further comprising an associated payout spool for each web, each web being wound as a roll on its associated spool for payout therefrom adjacent the corresponding head, each web comprising a last successive dye bearing area and a terminal end provided with a fixation point spaced a predetermined longitudinal distance from said last successive dye bearing area, and each web being affixed to its associated spool at the fixation point.

15. The device of claim 14 wherein the predetermined distance of each web corresponds substantially to the distance between its fixation point and the corresponding head after the last successive dye bearing area has been subjected to said cycle.

16. A method of operating a printing device comprising a plurality of printing means for printing arranged in succession along a path for individual operation in successive printing cycles, and comprising a first successive printing means and at least one remaining successive printing means, the method comprising the steps of:

(A) providing each printing means with an associated longitudinal dye transfer web comprising a predetermined number of longitudinally successive transfer dye bearing areas of constant first length disposed therealong, and longitudinally intervening dye-free areas of constant second length disposed therealong to delimit longitudinally the successive dye bearing areas, so that a dye bearing area and an adjacent dye-free area together define a metering increment of constant third length equal to a sum of the first length and second length, the dye bearing areas all being of a same color and such color being independent of a same color of the dye bearing areas of the web of each other printing means;

(B) individually advancing dye receiving sheets in succession along the path to each printing means for respective printing in a respective cycle at each printing means;

(C) individually moving the web of each printing means a respective said increment along the path to that printing means for dye transfer from a respective dye bearing area to a respective sheet for printing thereof in said respective cycle;

(D) individually sensing the successive dye bearing areas and dye-free areas of the web of each printing means upon moving said areas to that printing means in said cycles, and counting the sensed dye bearing areas and thereby indicating, relative to said predetermined number of dye bearing areas of the web of a given printing means, a number of dye bearing areas already subjected to said cycle and a number of remaining dye bearing areas not yet subjected to said cycle; and (E) controlling a cycle operation so that when said number of remaining dye bearing areas of the web of any printing means at an end of a said cycle corresponds to the number of printing means preceding that printing means along the path, further cycle operation is prevented at the first successive printing means while respective completion of the cycle operation is permitted for already advanced sheets at the remaining successive printing means.

17. The method of claim 16 wherein said preventing of further cycle operation at the first successive printing means includes preventing the advancing of a sheet to the first successive printing means.

* * * * *